US012305140B2

(12) United States Patent
Sunahara

(10) Patent No.: US 12,305,140 B2
(45) Date of Patent: May 20, 2025

(54) LUBRICATING OIL COMPOSITION

(71) Applicant: IDEMITSU KOSAN CO., LTD., Chiyoda-ku (JP)

(72) Inventor: Kenji Sunahara, Tsukuba (JP)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 0 days.

(21) Appl. No.: 18/260,800

(22) PCT Filed: Mar. 22, 2022

(86) PCT No.: PCT/JP2022/012963
§ 371 (c)(1),
(2) Date: Jul. 10, 2023

(87) PCT Pub. No.: WO2022/210065
PCT Pub. Date: Oct. 6, 2022

(65) Prior Publication Data

US 2024/0318096 A1 Sep. 26, 2024

(30) Foreign Application Priority Data

Mar. 31, 2021 (JP) ..... 2021-062407

(51) Int. Cl.

| | |
|---|---|
| ***C10M 169/04*** | (2006.01) |
| ***C10M 101/02*** | (2006.01) |
| ***C10M 171/02*** | (2006.01) |
| ***C10N 20/00*** | (2006.01) |
| ***C10N 20/02*** | (2006.01) |
| ***C10N 30/00*** | (2006.01) |
| ***C10N 30/02*** | (2006.01) |
| ***C10N 40/25*** | (2006.01) |

(52) U.S. Cl.
CPC ..... *C10M 169/041* (2013.01); *C10M 101/02* (2013.01); *C10M 171/02* (2013.01); *C10M 2207/2815* (2013.01); *C10M 2290/02* (2013.01); *C10N 2020/02* (2013.01); *C10N 2020/071* (2020.05); *C10N 2020/085* (2020.05); *C10N 2030/02* (2013.01); *C10N 2030/74* (2020.05); *C10N 2040/25* (2013.01)

(58) Field of Classification Search
CPC ..... C10M 169/041; C10M 2203/1025; C10M 2207/2815; C10M 2209/094; C10M 2209/1045; C10M 2290/02; C10N 2020/02; C10N 2020/071; C10N 2020/085; C10N 2020/203; C10N 2020/74; C10N 2040/25
See application file for complete search history.

(56) References Cited

U.S. PATENT DOCUMENTS

| | | | | |
|---|---|---|---|---|
| 2003/0022798 | A1 | 1/2003 | Bell et al. | |
| 2017/0009180 | A1 | 1/2017 | Chen et al. | |
| 2018/0134983 | A1 | 5/2018 | Broutin et al. | |
| 2019/0203148 | A1* | 7/2019 | Schöller | C08F 220/1804 |
| 2020/0216596 | A1* | 7/2020 | Schöller | C08F 8/32 |
| 2020/0339905 | A1* | 10/2020 | Champagne | C10M 169/02 |

FOREIGN PATENT DOCUMENTS

| | | | |
|---|---|---|---|
| JP | 2003-41284 | A | 2/2003 |
| JP | 2009-127531 | A | 6/2009 |
| JP | 2010-53252 | A | 3/2010 |
| JP | 2013-203849 | A | 10/2013 |
| JP | 2017-500426 | A | 1/2017 |
| JP | 2017-186461 | A | 10/2017 |
| JP | 2018-514621 | A | 6/2018 |
| JP | 2019-094429 | A | 6/2019 |
| WO | WO 2013/128748 | A1 | 9/2013 |

OTHER PUBLICATIONS

International Search Report and Written Opinion issued Jun. 14, 2022, in corresponding PCT/JP2022/012963 (with English translation), 14 pages.

Extended European Search Report issued Jan. 7, 2025 in European Patent Application No. 22780280.8, 8 pages.

Narmak Trade s.r.o., "Base Oil Yubase 4", pp. 1-6, Published May 11, 2017 by Narmak Trade s.r.o, as evidenced by (https://web.archive.org/web/20170511002106/https:/www.narmaktrade.cz/en/products/base-oils/base-oil-yubase-4), retrieved Feb. 12, 2025 at https://www.narmaktrade.cz/en/products/base-oils/base-oil-yubase-4.

* cited by examiner

*Primary Examiner* — James C Goloboy
(74) *Attorney, Agent, or Firm* — Oblon, McClelland, Maier & Neustadt, L.L.P.

(57) ABSTRACT

A lubricating oil composition that is hard to increase in viscosity in the low temperature range and is easy to increase in viscosity in the high temperature range. The lubricating oil composition contains a base oil and a viscosity index improver. The base oil contains a mineral oil and an oxygen-containing synthetic oil. The viscosity index improver contains a comb-shaped polymer. The lubricating oil composition has a kinematic viscosity of 100° C. of 9.3 $mm^2/s$ or less, a viscosity index of 280 or more, and a content Y (% by mass) of the oxygen-containing synthetic oil based on the total amount of the lubricating oil composition satisfying the following expression (1): $\alpha \leq Y < -3.7 \ln(X) + \beta$ (1), where $\alpha=0.5$, $\beta=19$, and X represents a ratio of the number of carbon atoms and the number of oxygen atoms per one molecule of the oxygen-containing synthetic oil.

13 Claims, No Drawings

LUBRICATING OIL COMPOSITION

CROSS REFERENCE TO RELATED APPLICATIONS

This application is a National Stage entry under 35 U.S.C. § 371 of PCT/JP2022/012963, filed on Mar. 22, 2022, and claims priority to Japanese Patent Application No. 2021-062407, filed on Mar. 31, 2021, the entire contents of which are incorporated herein by reference.

TECHNICAL FIELD

The present invention relates to a lubricating oil composition.

BACKGROUND ART

The reduction in viscosity of an engine oil is one of the fuel saving measures of internal combustion engines.

The reduction in viscosity of an engine oil is effective for reducing the agitation loss and for reducing the friction coefficient in the fluid lubricating part. In contrast, the reduction in viscosity of an engine oil causes increase of the evaporation amount thereof through lightening of the base oil, which leads problems including increase of the consumption amount of the engine oil. In view of these points, various lubricating oil compositions have been proposed (see, for example, PTLs 1 to 3).

CITATION LIST

Patent Literatures

PTL 1: JP 2018-514621 A
PTL 2: JP 2017-500426 A
PTL 3: JP 2010-53252 A

SUMMARY OF INVENTION

Technical Problem

Various types of hybrid automobiles including a combination of an electric motor and an internal combustion engine are being spread in recent years as one measure for improving the fuel efficiency of automobiles.

The hybrid automobile has a tendency that the oil temperature does not rise due to the lower operating rate of the internal combustion engine than the ordinary engine automobiles. Therefore, for improving the fuel efficiency of the internal combustion engine used in the hybrid automobile, it is important that the engine oil used therein is reduced in viscosity in a low temperature range around 40° C. On the other hand, in a high temperature range of 80° C. or more, the reduction in viscosity of the engine oil in the high temperature range has a concern that the boundary lubrication is increased to deteriorate the wear resistance and the hydraulic characteristics and to fail to retain the oil film thickness, and thus the viscosity of the engine oil is necessarily increased. Consequently, there is a demand of an engine oil that is hard to increase in viscosity in the low temperature range but is easy to increase in viscosity in the high temperature range.

An effective measure for addressing the demand is the enhancement of the viscosity index of the lubricating oil composition by blending a viscosity index improver in the lubricating oil composition.

However, the viscosity index improver generally has an effect of increasing the viscosity in the low temperature range corresponding to the capability thereof of improving the viscosity index. Therefore, the viscosity of the base oil is necessarily set lower corresponding to the effect of increasing the viscosity, but the viscosity of the base oil set lower leads the increase of the evaporation amount of the lubricating oil composition as described above. Accordingly, there is a demand of measures including the use of a synthetic oil having a low viscosity for facilitating the suppression of the evaporation amount of the lubricating oil composition.

Furthermore, in the case where the increase in viscosity in the low temperature range is suppressed by using the base oil having a low viscosity or by using the viscosity index improver, the capability of increasing the viscosity in the high temperature range may be insufficient. Therefore, there is a demand of measures for securing the capability of increasing the viscosity in the high temperature range.

PTLs 1 to 3 propose the lubricating oil compositions having a synthetic oil blended with a viscosity index improver. However, the lubricating oil compositions are not sufficiently investigated for the features that the viscosity of the lubricating oil composition is sufficiently reduced in a low temperature range around 40° C., and the capability of increasing the viscosity in the high temperature range is secured.

Under the circumstances, a problem to be solved by the present invention is to provide a lubricating oil composition that is hard to increase in viscosity in the low temperature range, resulting in an excellent fuel saving capability, and is easy to increase in viscosity in the high temperature range, resulting in excellent wear resistance and excellent hydraulic characteristics, and easily securing an oil film.

Solution to Problem

As a result of earnest investigations accumulated by the present inventors, it has been found that the problem can be solved by a lubricating oil composition that contains a mineral oil having an oxygen-containing synthetic oil and a comb-shaped polymer added thereto, and has a content of the oxygen-containing synthetic oil regulated to a particular range.

Specifically, the present invention relates to the following items [1] to [3].

[1] A lubricating oil composition containing a base oil (A) and a viscosity index improver (B), the base oil (A) containing a mineral oil (A1) and an oxygen-containing synthetic oil (A2), the viscosity index improver (B) containing a comb-shaped polymer (B1), the lubricating oil composition having a kinematic viscosity at 100° C. of 9.3 $mm^2/s$ or less, a viscosity index of 280 or more, and a content Y (unit: % by mass) of the oxygen-containing synthetic oil (A2) based on the total amount of the lubricating oil composition satisfying the following expression (1):

$$\alpha \leq Y < -3.7\ln(X) + \beta \quad (1)$$

wherein in the expression (1), $\alpha=0.5$, $\beta=19$, and X represents a ratio (C/O) of the number of carbon atoms and the number of oxygen atoms per one molecule of the oxygen-containing synthetic oil (A2).

[2] A use method including using the lubricating oil composition according to the item [1] in an internal combustion engine of an automobile.

[3] A method for producing a lubricating oil composition, including mixing a base oil (A) and a viscosity index improver (B), the base oil (A) containing a mineral oil (A1) and an oxygen-containing synthetic oil (A2), the viscosity index improver (B) containing a comb-shaped polymer (B1), the lubricating oil composition having a kinematic viscosity at 100° C. regulated to 9.3 $mm^2/s$ or less, a viscosity index regulated to 280 or more, and a content Y (unit: % by mass) of the oxygen-containing synthetic oil (A2) based on the total amount of the lubricating oil composition being regulated to satisfy the following expression (1):

$$\alpha \leq Y < -3.7\ln(X) + \beta \quad (1)$$

wherein in the expression (1), α=0.5, β=19, and X represents a ratio (C/O) of the number of carbon atoms and the number of oxygen atoms per one molecule of the oxygen-containing synthetic oil (A2).

Advantageous Effects of Invention

The present invention can provide a lubricating oil composition that is hard to increase in viscosity in the low temperature range, resulting in an excellent fuel saving capability, and is easy to increase in viscosity in the high temperature range, resulting in excellent wear resistance and excellent hydraulic characteristics, and easily securing an oil film.

DESCRIPTION OF EMBODIMENTS

In the description herein, the lower limit values and the upper limit values defined in a stepwise manner for the preferred numerical ranges (for example, the range of the content) each may be independently combined. For example, the description of the numerical range "preferably A to B, and more preferably C to D" can derive "A to D" by combining the "preferred lower limit value A" and the "more preferred upper limit value D".

In the description herein, the description of the numerical range "A to B" means "A or more and B or less" unless otherwise indicated.

In the description herein, the numerical values in the examples each are a numerical value that can be used as an upper limit value or a lower limit value.

In the description herein, the kinematic viscosity at 40° C. (which may be hereinafter referred to as a "40° C. kinematic viscosity") and the kinematic viscosity at 100° C. (which may be hereinafter referred to as a "100° C. kinematic viscosity") each are a value that is measured according to JIS K2283:2000.

In the description herein, the viscosity index is a value that is calculated from the measured value of the 40° C. kinematic viscosity and the measured value of the 100° C. kinematic viscosity according to JIS K2283:2000.

Embodiments of Lubricating Oil Composition of Present Invention

The additive for a lubricating oil of the present invention is a lubricating oil composition containing a base oil (A) and a viscosity index improver (B).

The base oil (A) contains a mineral oil (A1) and an oxygen-containing synthetic oil (A2).

The viscosity index improver (B) contains a comb-shaped polymer (B1).

The kinematic viscosity at 100° C. is 9.3 $mm^2/s$ or less.

The viscosity index is 280 or more.

The content Y (unit: % by mass) of the oxygen-containing synthetic oil (A2) based on the total amount of the lubricating oil composition satisfies the following expression (1):

$$\alpha \leq Y < -3.7\ln(X) + \beta \quad (1)$$

wherein in the expression (1), α=0.5, β=19, and X represents a ratio (C/O) of the number of carbon atoms and the number of oxygen atoms per one molecule of the oxygen-containing synthetic oil (A2).

The present inventors have made earnest investigations for solving the problem.

As a result of the investigations on the viscosity index improver firstly, it has been found that the use of a comb-shaped polymer as the viscosity index improver is effective for providing the lubricating oil composition having the aforementioned characteristics. Furthermore, as a result of the investigations on the synthetic oil in consideration of the fact that the evaporation amount can be easily suppressed irrespective of the low viscosity thereof, it has been found that the use of an oxygen-containing synthetic oil as the synthetic oil can enhance the viscosity index of the lubricating oil composition.

Based on the aforementioned knowledge, the present inventors have made various investigations on a lubricating oil composition containing a mineral oil having an oxygen-containing synthetic oil and a comb-shaped polymer blended therein. However, there have been some cases where the viscosity of the lubricating oil composition is increased in the low temperature range and some cases where the effect of increasing the viscosity in the high temperature range is insufficient although the viscosity can be reduced in the low temperature range.

As a result of the earnest investigations further made by the present inventors for pursuing the mechanism of the aforementioned cases, it has been found that the problem can be solved by regulating the content of the oxygen-containing synthetic oil to the specific range, and thus the present invention has been completed.

In the following description, the "base oil (A)" and the "viscosity index improver (B)" may be referred to as a "component (A)" and a "component (B)", respectively.

The lubricating oil composition according to one embodiment of the present invention may be constituted only by the component (A) and the component (B), or may contain other components than the component (A) and the component (B).

In the lubricating oil composition according to one embodiment of the present invention, the total content of the component (A) and the component (B) is preferably 70% by mass or more, more preferably 75% by mass or more, and further preferably 80% by mass or more, based on the total amount of the lubricating oil composition. The total content thereof is preferably 100% by mass or less, more preferably less than 100% by mass, and further preferably 95% by mass or less.

The upper limit values and the lower limit values of these numerical ranges may be optionally combined. Specifically, the total content thereof is preferably 70% by mass to 100% by mass, more preferably 75% by mass to less than 100% by mass, and further preferably 80% by mass to 95% by mass.

The components contained in the lubricating oil composition of the present invention will be described in detail below.

[Base Oil (A)]

The base oil (A) contains a mineral oil (A1) and an oxygen-containing synthetic oil (A2).

In the case where the base oil (A) does not contain the oxygen-containing synthetic oil (A2), the viscosity index of the lubricating oil composition cannot be enhanced sufficiently.

In the lubricating oil composition according to one embodiment of the present invention, the base oil (A) may be constituted only by the mineral oil (A1) and the oxygen-containing synthetic oil (A2), and may contain a base oil other than the mineral oil (A1) and the oxygen-containing synthetic oil (A2) in such a range that does not deviate from the spirit of the present invention.

In the lubricating oil composition according to one embodiment of the present invention, the total content of the mineral oil (A1) and the oxygen-containing synthetic oil (A2) is preferably 70% by mass to 100% by mass, more preferably 80% by mass to 100% by mass, further preferably 90% by mass to 100% by mass, still further preferably 95% by mass to 100% by mass, and still more further preferably 99% by mass to 100% by mass, based on the total amount of the base oil (A).

<Mineral Oil (A1)>

The mineral oil (A1) used may be an ordinary mineral oil used as a lubricant base oil with no particular limitation.

Specific examples of the mineral oil (A1) include an atmospheric residual oil obtained by subjecting a crude oil, such as a paraffin-based crude oil, an intermediate-based crude oil, and a naphthene-based crude oil, to atmospheric distillation; a distillate oil obtained by subjecting the atmospheric residual oil to distillation under reduced pressure; a mineral oil obtained by subjecting the distillate oil to one or more kind of a treatment selected from solvent deasphalting, solvent extraction, hydrogenation cracking, solvent dewaxing, catalytic dewaxing, hydrogenation refining, and the like; and a mineral oil obtained by isomerizing wax.

One kind of the mineral oil (A1) may be used alone, or two or more kinds thereof may be used in combination.

The mineral oil (A1) is more preferably a mineral oil classified into Group II or III, more preferably a mineral oil classified into Group III, of the American Petroleum Institute (API).

(Properties of Mineral Oil (A1))

The 100° C. kinematic viscosity of the mineral oil (A1) is preferably 2.0 $mm^2/s$ or more, more preferably 2.5 $mm^2/s$ or more, and further preferably 3.0 $mm^2/s$ or more, from the standpoint of facilitating the suppression of the evaporation amount of the lubricating oil composition, and the standpoint of the oil film retention capability. The 100° C. kinematic viscosity thereof is preferably 5.0 $mm^2/s$ or less, more preferably 4.7 $mm^2/s$ or less, and further preferably 4.5 $mm^2/s$ or less, from the standpoint of facilitating the reduction of the viscosity of the lubricating oil composition in the low temperature range.

The upper limit values and the lower limit values of these numerical ranges can be optionally combined. Specifically, the 100° C. kinematic viscosity thereof is preferably 2.0 $mm^2/s$ to 5.0 $mm^2/s$, more preferably 2.5 $mm^2/s$ to 4.7 $mm^2/s$, and further preferably 3.0 $mm^2/s$ to 4.5 $mm^2/s$.

The 40° C. kinematic viscosity of the mineral oil (A1) is preferably 10.0 $mm^2/s$ or more, more preferably 13.0 $mm^2/s$ or more, and further preferably 15.0 $mm^2/s$ or more, from the standpoint of facilitating the suppression of the evaporation amount of the lubricating oil composition, and the standpoint of the oil film retention capability. The 40° C. kinematic viscosity thereof is preferably 25.0 $mm^2/s$ or less, more preferably 20.0 $mm^2/s$ or less, and further preferably 18.0 $mm^2/s$ or less, from the standpoint of facilitating the reduction of the viscosity of the lubricating oil composition in the low temperature range.

The upper limit values and the lower limit values of these numerical ranges can be optionally combined. Specifically, the 40° C. kinematic viscosity thereof is preferably 10.0 $mm^2/s$ to 25.0 $mm^2/s$, more preferably 13.0 $mm^2/s$ to 20.0 $mm^2/s$, and further preferably 15.0 $mm^2/s$ to 18.0 $mm^2/s$.

The viscosity index of the mineral oil (A1) is preferably 90 or more, more preferably 100 or more, and further preferably 110 or more.

The Noack evaporation loss of the mineral oil (A1) is preferably less than 40% by mass, more preferably 30% by mass or less, and further preferably 20% by mass or less, from the standpoint of facilitating the suppression of the evaporation amount of the lubricating oil composition. The Noack evaporation loss thereof is generally 10% by mass or more.

In the case where the mineral oil (A1) is a mixture of two or more components, it suffices that the kinematic viscosities, the viscosity index, and the Noack evaporation loss of the mixture are in the aforementioned ranges.

(Content of Mineral Oil (A1))

The content of the mineral oil (A1) is preferably 60% by mass or more, more preferably 65% by mass or more, and further preferably 68% by mass or more, from the standpoint of facilitating the exertion of the effects of the present invention. The content thereof is preferably 90% by mass or less, more preferably 87% by mass or less, and further preferably 85% by mass or less.

The upper limit values and the lower limit values of these numerical ranges can be optionally combined. Specifically, the content thereof is preferably 60% by mass to 90% by mass, more preferably 65% by mass to 87% by mass, and further preferably 68% by mass to 85% by mass.

<Oxygen-Containing Synthetic Oil (A2)>

The oxygen-containing synthetic oil (A2) used may be an ordinary mineral oil used as a lubricant base oil with no particular limitation.

In the description herein, the term "oxygen-containing" in the "oxygen-containing synthetic oil" means that an oxygen atom exists in the molecule constituting the synthetic oil.

In the lubricating oil composition according to one embodiment of the present invention, preferred examples of the oxygen-containing synthetic oil (A2) include one or more kind selected from the group consisting of an ester oil, an ether oil, and an alcohol oil, more preferred examples thereof include one or more kind selected from the group consisting of an ester oil and an ether oil, and further preferred examples thereof include an ester oil.

(Ester Oil)

The ester oil used may be an ordinary ester oil used as a lubricant base oil with no particular limitation.

In the lubricating oil composition according to one embodiment of the present invention, preferred examples of the ester oil include one or more kind selected from the group consisting of a monoester oil, a diester oil, and a polyol ester oil, and more preferred examples thereof include one or more kind selected from the group consisting of a monoester oil and a diester oil, from the standpoint of facilitating the exertion of the effects of the present invention.

Monoester Oil

Examples of the monoester oil include a monoester of a monohydric alcohol and a monobasic acid. The number of oxygen atoms per one molecule of the monoester may be determined in consideration of the number of oxygen atoms contained in the monohydric alcohol and the monobasic acid constituting the monoester and the number of oxygen atoms that is decreased through the esterification reaction, which is generally 2.

Preferred examples of the monohydric alcohol constituting the monoester include a monohydric aliphatic alcohol having 1 to 24 carbon atoms, more preferred examples thereof include a monohydric aliphatic alcohol having 1 to 12 carbon atoms, and further preferred examples thereof include a monohydric aliphatic alcohol having 1 to 10 carbon atoms, from the standpoint of facilitating the exertion of the effects of the present invention.

The monohydric aliphatic alcohol may be either linear or branched, and may be either saturated or unsaturated.

Specific examples of the monohydric alcohol constituting the monoester include methanol, ethanol, propanol, butanol, pentanol, hexanol, heptanol, octanol, 2-ethylhexanol, 3,5-dimethylhexanol, nonanol, decanol, undecanol, dodecanol, tridecanol, tetradecanol, pentadecanol, hexadecanol, heptadecanol, octadecanol, nonadecanol, icosanol, henicosanol, docosanol, tricosanol, and tetracosanol, and also include butenol, pentenol, hexenol, heptenol, octenol, nonenol, decenol, undecenol, dodecenol, tridecenol, tetradecenol, pentadecenol, hexadecenol, heptadecenol, octadecnol, nonadecenol, icosenol, henicosenol, docosenol, tricosenol, and tetracosenol.

Preferred examples of the monobasic acid constituting the monoester include an aliphatic monocarboxylic acid having 2 to 24 carbon atoms, more preferred examples thereof include an aliphatic monocarboxylic acid having 4 to 22 carbon atoms, and further preferred examples thereof include an aliphatic monocarboxylic acid having 6 to 20 carbon atoms, from the standpoint of facilitating the exertion of the effects of the present invention.

The aliphatic monocarboxylic acid may be either linear or branched, and may be either saturated or unsaturated.

Specific examples of the monobasic acid constituting the monoester include acetic acid, propionic acid, butanoic acid, pentanoic acid, hexanoic acid, heptanoic acid, octanoic acid, nonanoic acid, decanoic acid undecanoic acid, dodecanoic acid, tridecanoic acid, tetradecanoic acid, pentadecanoic acid, hexadecanoic acid (palmitic acid), heptadecanoic acid, octadecanoic acid, nonadecanoic acid, icosanoic acid, heneicosanoic acid, docosanoic acid, tricosanoic acid, and tetracosanoic acid, and also include acrylic acid, methacrylic acid, butenoic acid, pentenoic acid, hexenoic acid, heptenoic acid, octenoic acid, nonenoic acid, decenoic acid, undecenoic acid, dodecenoic acid, tridecenoic acid, tetradecenoic acid, pentadecenoic acid, hexadecenoic acid, heptadecenoic acid, octadecenoic acid, nonadecenoic acid, icosenoic acid, heneicosenoic acid, docosenoic acid, tricosenoic acid, and tetracosenoic acid.

One kind of the monoester may be used alone, and two or more kinds thereof may be used in combination.

The monoester preferably has a ratio (C/O) of the number of carbon atoms and the number of oxygen atoms of 2 to 24, more preferably 3 to 20, and further preferably 4 to 15, from the standpoint of facilitating the exertion of the effects of the present invention.

Diester Oil

Examples of the diester oil include a diester of a monohydric alcohol and a dibasic acid. The number of oxygen atoms per one molecule of the diester may be determined in consideration of the number of oxygen atoms contained in the monohydric alcohol and the dibasic acid constituting the diester and the number of oxygen atoms that is decreased through the esterification reaction, which is generally 4.

Preferred examples of the monohydric alcohol constituting the diester include a monohydric aliphatic alcohol having 1 to 24 carbon atoms, more preferred examples thereof include a monohydric aliphatic alcohol having 1 to 12 carbon atoms, and further preferred examples thereof include a monohydric aliphatic alcohol having 1 to 10 carbon atoms, from the standpoint of facilitating the exertion of the effects of the present invention.

The monohydric aliphatic alcohol may be either linear or branched, and may be either saturated or unsaturated.

Specific examples of the monohydric alcohol constituting the diester include the same alcohols as the alcohols described as the specific examples of the monohydric alcohol constituting the monoester.

Preferred examples of the dibasic acid constituting the diester include an aliphatic dicarboxylic acid having 2 to 24 carbon atoms, more preferred examples thereof include an aliphatic dicarboxylic acid having 4 to 16 carbon atoms, and further preferred examples thereof include an aliphatic dicarboxylic acid having 6 to 12 carbon atoms, from the standpoint of facilitating the exertion of the effects of the present invention. The aliphatic dicarboxylic acid may be either linear or branched, and may be either saturated or unsaturated.

Specific examples of the dibasic acid constituting the diester include ethanedioic acid, propanedioic acid, butanedioic acid, pentanedioic acid, hexanedioic acid, heptanedioic acid, octanedioic acid, nonanedioic acid, decanedioic acid, undecanedioic acid, dodecanedioic acid, tridecanedioic acid, tetradecanedioic acid, pentadecanedioic acid, hexadecanedioic acid, heptadecanedioic acid, octadecanedioic acid, nonadecanedioic acid, icosanedioic acid, henicosanedioic acid, docosanedioic acid, tricosanedioic acid, and tetracosanedioic acid, and also include butenedioic acid, pentenedioic acid, hexenedioic acid, heptenedioic acid, octenedioic acid, nonenedioic acid, decenedioic acid, undecenedioic acid, dodecenedioic acid, tridecenedioic acid, tetradecenedioic acid, pentadecenedioic acid, hexadecenedioic acid, heptadecenedioic acid, octadecenedioic acid, nonadecenedioic acid, icosenedioic acid, henicosenedioic acid, docosenedioic acid, tricosenedioic acid, and tetracosenedioic acid.

One kind of the diester may be used alone, and two or more kinds thereof may be used in combination.

The diester preferably has a ratio (C/O) of the number of carbon atoms and the number of oxygen atoms of 1 to 18, more preferably 2 to 14, and further preferably 3 to 10, from the standpoint of facilitating the exertion of the effects of the present invention.

Polyol Ester Oil

The polyol ester oil is an ester that is a condensate of a polyol and a fatty acid. The number of oxygen atoms per one molecule of the polyol ester may be determined in consideration of the number of oxygen atoms contained in the polyol and the fatty acid constituting the polyol ester and the number of oxygen atoms that is decreased through the esterification reaction, which is generally 4 to 12, and is preferably 4 to 10, more preferably 4 to 8, and further preferably 6, from the standpoint of facilitating the exertion of the effects of the present invention.

The number of hydroxy groups of the polyol constituting the polyol ester is preferably 2 to 6, more preferably 2 to 5, and further preferably 2 to 4, from the standpoint of facilitating the exertion of the effects of the present invention.

The number of carbon atoms of the polyol is preferably 2 to 20, more preferably 2 to 15, and further preferably 2 to 10, from the standpoint of facilitating the exertion of the effects of the present invention.

Specific examples of the polyol constituting the polyol ester include a diol, such as ethylene glycol, 1,3-propanediol, propylene glycol, 1,4-butanediol, 1,2-butanediol, 2-methyl-1,3-propanediol, 1,5-pentanediol, neopentyl glycol, 1,6-hexanediol, 2-ethyl-2-methyl-1,3-propanediol, 1,7-pentanediol, 2-methyl-2-propyl-1,3-propanediol, 2,2-diethyl-1,3-propanediol, 1,8-octanediol, 1,9-nonanediol, 1,10-decanediol, 1,11-undecanediol, and 1,12-dodecanediol; a polyhydric alcohol, such as trimethylolethane, trimethylolpropane, trimethylolbutane, ditrimethylolpropane, pentaerythritol, glycerin, glycerin dimer, 1,3,5-pentanetriol, sorbitol, sorbitan, adonitol, arabitol, xylitol, and mannitol; and a sugar, such as xylose, arabinose, ribose, rhamnose, glucose, fructose, galactose, mannose, and sorbose.

Among these, neopentyl glycol, trimethylolethane, trimethylolpropane, trimethylolbutane, and pentaerythritol are preferred, trimethylolethane, trimethylolpropane, and trimethylolbutane are more preferred, and trimethylolpropane is further preferred.

Preferred examples of the fatty acid constituting the polyol ester include an aliphatic monocarboxylic acid having 2 to 14 carbon atoms, more preferred examples thereof include an aliphatic monocarboxylic acid having 2 to 10 carbon atoms, and further preferred examples thereof include an aliphatic monocarboxylic acid having 2 to 8 carbon atoms, from the standpoint of facilitating the exertion of the effects of the present invention.

The aliphatic monocarboxylic acid may be either linear or branched, and may be either saturated or unsaturated.

Specific examples of the fatty acid constituting the polyol ester include acetic acid, propionic acid, butanoic acid, pentanoic acid, hexanoic acid, heptanoic acid, octanoic acid, nonanoic acid, decanoic acid, undecanoic acid, dodecanoic acid, tridecanoic acid, and tetradecanoic acid, and also include acrylic acid, methacrylic acid, butenoic acid, pentenoic acid, hexenoic acid, heptenoic acid, octenoic acid, nonenoic acid, decenoic acid, undecenoic acid, dodecenoic acid, tridecenoic acid, and tetradecenoic acid.

One kind of the polyol ester may be used alone, and two or more kinds thereof may be used in combination.

The diester preferably has a ratio (C/O) of the number of carbon atoms and the number of oxygen atoms of 1 to 10, more preferably 2 to 8, and further preferably 2 to 6, from the standpoint of facilitating the exertion of the effects of the present invention.

(Ether Oil)

The ether oil used may be an ordinary ether oil used as a lubricant base oil with no particular limitation.

In the lubricating oil composition according to one embodiment of the present invention, preferred examples of the ether oil include a polyoxyalkylene glycol compound represented by the following general formula (I) from the standpoint of facilitating the exertion of the effects of the present invention.

$$R^{a1}O—(R^{a2}O)_n—R^{a3} \quad (I)$$

In the general formula (I), $R^{a2}$ represents an alkylene group having 2 to 6 carbon atoms.

$R^{a1}$ and $R^{a3}$ each independently represent a hydrogen atom, an alkyl group having 1 to 10 carbon atoms, an acyl group having 1 to 11 carbon atoms, or a saturated or unsaturated alicyclic hydrocarbon group or an aromatic hydrocarbon group that each have 5 to 18 carbon atoms and may have a substituent.

n represents an integer of 2 or more, preferably 6 to 30, more preferably 10 to 25, and further preferably 15 to 25. The value of n may be appropriately regulated corresponding to the kinematic viscosity demanded for the ether oil. The number of oxygen atoms per one molecule of the polyoxyalkylene glycol compound may be determined in consideration of the number of oxygen atoms of the end alkoxy group and the polyoxyalkylene group constituting the polyoxyalkylene glycol compound, which is generally n+1.

In the case where plural units represented by $(R^{a2}O)$ exist, i.e., in the case of $n \geq 2$, the plural units represented by $(R^{a2}O)$ may be the same as or different from each other. In the case where the plural units represented by $(R^{a2}O)$ are different from each other, the units may be either a random type or a block type, and is preferably a random type from the standpoint of the handleability.

In the description herein, the compound represented by the general formula (I) that has hydrogen atoms at both ends thereof is referred to as a polyoxyalkylene glycol, and the compound that has a substituent other than a hydrogen atom at at least one end thereof is referred to as a polyoxyalkylene glycol derivative. The "polyoxyalkylene glycol compound" is a concept that encompasses both the polyoxyalkylene glycol and the polyoxyalkylene glycol derivative.

Examples of the alkyl group having 1 to 10 carbon atoms that can be selected as $R^{a1}$ and $R^{a3}$ include a methyl group, an ethyl group, a n-propyl group, an isopropyl group, a n-butyl group, an isobutyl group, a sec-butyl group, a tert-butyl group, a hexyl group, a 2-ethylhexyl group, a heptyl group, an octyl group, a nonyl group, and a decyl group.

Examples of the acyl group having 1 to 11 carbon atoms that can be selected as $R^{a1}$ and $R^{a3}$ include a group having an alkyl group having 1 to 10 carbon atoms and a carbonyl group.

Examples of the saturated alicyclic hydrocarbon group having 5 to 18 carbon atoms that can be selected as $R^{a1}$ and $R^{a3}$ include a cyclopentyl group, a cyclohexyl group, a cycloheptyl group, a cyclooctyl group, a cyclononyl group, and a cyclodecyl group.

Examples of the unsaturated alicyclic hydrocarbon group having 5 to 18 carbon atoms that can be selected as $R^{a1}$ and $R^{a3}$ include a cyclopentenyl group and a cyclohexenyl group.

Examples of the aromatic hydrocarbon group having 5 to 18 carbon atoms that can be selected as $R^{a1}$ and $R^{a3}$ include an aryl group, such as a phenyl group and a naphthyl group.

Examples of the substituent include $C_1$ to $C_6$ alkyl groups, $C_1$ to $C_6$ alkoxy groups, and $C_6$ to $C_{14}$ aryl groups.

The polyoxyalkylene glycol compound is preferably a polyoxyalkylene glycol derivative having the $(R^{a2}O)$ unit in the general formula (I) that is constituted by one or more kind of an alkylene oxide selected from the group consisting of ethylene oxide, propylene oxide, and butylene oxide, and having $R^{a1}$ and $R^{a3}$ therein that each represent an alkyl group having 1 to 10 carbon atoms, from the standpoint of facilitating the exertion of the effects of the present invention. The $(R^{a2}O)$ unit in the general formula (I) is preferably ethylene oxide or propylene oxide, and more preferably ethylene oxide, from the same standpoint.

One kind of the polyoxyalkylene glycol compound may be used alone, and two or more kinds thereof may be used in combination.

The polyoxyalkylene glycol compound preferably has a ratio (C/O) of the number of carbon atoms and the number of oxygen atoms of 2 to 7, more preferably 2 to 5, and further preferably 2 to 4, from the standpoint of facilitating the exertion of the effects of the present invention.

(Alcohol Oil)

The alcohol oil used may be an ordinary alcohol oil used as a lubricant base oil with no particular limitation, and preferred examples thereof include a monohydric aliphatic alcohol having 10 to 24 carbon atoms, more preferred examples thereof include a monohydric aliphatic alcohol having 12 to 20 carbon atoms, and further preferred examples thereof include a monohydric aliphatic alcohol having 14 to 20 carbon atoms, from the standpoint of facilitating the exertion of the effects of the present invention.

The monohydric aliphatic alcohol may be either linear or branched, and may be either saturated or unsaturated.

Specific examples of the monohydric alcohol constituting the monoester include decanol, undecanol, dodecanol, tridecanol, tetradecanol, pentadecanol, hexadecanol, heptadecanol, octadecanol, isooctadecanol, nonadecanol, icosanol, henicosanol, docosanol, tricosanol, and tetracosanol, and also include butenol, pentenol, hexenol, heptenol, octenol, nonenol, decenol, undecenol, dodecenol, tridecenol, tetradecenol, pentadecenol, hexadecenol, heptadecenol, octadecenol, nonadecenol, icosenol, henicosenol, docosenol, tricosenol, and tetracosenol.

One kind of the alcohol may be used alone, or two or more kinds thereof may be used in combination.

The alcohol preferably has a ratio (C/O) of the number of carbon atoms and the number of oxygen atoms of 1 to 40, more preferably 10 to 30, and further preferably 15 to 25, from the standpoint of facilitating the exertion of the effects of the present invention.

(Properties of Oxygen-Containing Synthetic Oil (A2))

The 100° C. kinematic viscosity of the oxygen-containing synthetic oil (A2) is preferably 1.5 $mm^2/s$ or more, more preferably 2.0 $mm^2/s$ or more, further preferably 2.5 $mm^2/s$ or more, and still further preferably 3.0 $mm^2/s$ or more, from the standpoint of facilitating the suppression of the evaporation amount of the lubricating oil composition, and the standpoint of the oil film retention capability. The 100° C. kinematic viscosity thereof is preferably 5.0 $mm^2/s$ or less, more preferably 4.5 $mm^2/s$ or less, and further preferably 4.3 $mm^2/s$ or less, from the standpoint of facilitating the reduction of the viscosity of the lubricating oil composition in the low temperature range.

The upper limit values and the lower limit values of these numerical ranges can be optionally combined. Specifically, the 100° C. kinematic viscosity thereof is preferably 1.5 $mm^2/s$ to 5.0 $mm^2/s$, more preferably 2.0 $mm^2/s$ to 5.0 $mm^2/s$, further preferably 2.5 $mm^2/s$ to 4.5 $mm^2/s$, and still further preferably 3.0 $mm^2/s$ to 4.3 $mm^2/s$.

The 40° C. kinematic viscosity of the oxygen-containing synthetic oil (A2) is preferably 3.0 $mm^2/s$ or more, more preferably 4.0 $mm^2/s$ or more, and further preferably 5.0 $mm^2/s$ or more, from the standpoint of facilitating the suppression of the evaporation amount of the lubricating oil composition, and the standpoint of the oil film retention capability. The 40° C. kinematic viscosity thereof is preferably 25.0 $mm^2/s$ or less, more preferably 22.0 $mm^2/s$ or less, and further preferably 20.0 $mm^2/s$ or less, from the standpoint of facilitating the reduction of the viscosity of the lubricating oil composition in the low temperature range.

The upper limit values and the lower limit values of these numerical ranges can be optionally combined. Specifically, the 40° C. kinematic viscosity thereof is preferably 3.0 $mm^2/s$ to 25.0 $mm^2/s$, more preferably 4.0 $mm^2/s$ to 22.0 $mm^2/s$, and further preferably 5.0 $mm^2/s$ to 20.0 $mm^2/s$.

The viscosity index of the oxygen-containing synthetic oil (A2) is preferably 100 or more, more preferably 110 or more, and further preferably 120 or more.

The Noack evaporation loss of the oxygen-containing synthetic oil (A2) is preferably less than 40% by mass, more preferably 37% by mass or less, and further preferably 35% by mass or less, from the standpoint of facilitating the suppression of the evaporation amount of the lubricating oil composition. The Noack evaporation loss thereof is generally 1% by mass or more.

In the case where the oxygen-containing synthetic oil (A2) is a mixture of two or more components, it suffices that the kinematic viscosities and the viscosity index of the mixture are in the aforementioned ranges.

(Content of Oxygen-Containing Synthetic Oil (A2))

In the additive for a lubricating oil of the present invention, the content of the oxygen-containing synthetic oil (A2) is regulated to the particular range.

Specifically, the content Y (unit: % by mass) of the oxygen-containing synthetic oil (A2) based on the total amount of the lubricating oil composition is regulated to satisfy the following expression (1):

$$\alpha \leq Y < -3.7\ln(X) + \beta \quad (1)$$

wherein in the expression (1), $\alpha=0.5$, $\beta=19$, and X represents a ratio (C/O) of the number of carbon atoms and the number of oxygen atoms per one molecule of the oxygen-containing synthetic oil (A2).

ln(X) means the natural logarithm of X.

In the case of $Y<\alpha$, the viscosity index of the lubricating oil composition cannot be sufficiently enhanced.

In the case of $Y\geq-3.7\ln(X)+\beta$, the effect of increasing the viscosity of the lubricating oil composition in the low temperature range by the comb-shaped polymer (B1) blended as the viscosity index improver (B) is increased to fail to reduce the viscosity of the lubricating oil composition in the low temperature range.

The value of $\alpha$ is preferably 1.0, more preferably 2.0, further preferably 3.0, still further preferably 4.0, and still more further preferably 4.5, from the standpoint of facilitating the enhancement of the viscosity index of the lubricating oil composition.

The value of $\beta$ is preferably 18.5, more preferably 18, further preferably 17.2, and particularly preferably 16.2, from the standpoint of facilitating the reduction of the viscosity of the lubricating oil composition in the low temperature range.

In the case where the oxygen-containing synthetic oil (A2) is the monoester, the content of the oxygen-containing synthetic oil (A2) based on the total amount of the lubricating oil composition is preferably 0.5% by mass or more, more preferably 1.0% by mass or more, further preferably 2.0% by mass or more, further preferably 3.0% by mass or more, still further preferably 4.0% by mass or more, and still more further preferably 4.5% by mass or more. The content thereof is preferably less than 15% by mass, more preferably 14% by mass or less, further preferably 13% by mass or less, still further preferably 12% by mass or less, and still more further preferably 11% by mass or less.

The upper limit values and the lower limit values of these numerical ranges may be optionally combined. Specifically, the content thereof is preferably 0.5% by mass to less than 15% by mass, more preferably 1.0% by mass to 14% by mass, further preferably 2.0% by mass to 13% by mass, still further preferably 3.0% by mass to 12% by mass, still more further preferably 4.0% by mass to 11% by mass, and still more further preferably 4.5% by mass to 11% by mass.

In the case where the oxygen-containing synthetic oil (A2) is the diester, the content of the oxygen-containing synthetic oil (A2) based on the total amount of the lubricating oil composition is preferably 0.5% by mass or more, more preferably 1.0% by mass or more, further preferably 2.0% by mass or more, further preferably 3.0% by mass or more, still further preferably 4.0% by mass or more, and still more further preferably 4.5% by mass or more. The content thereof is preferably less than 15% by mass, more preferably 14% by mass or less, further preferably 13% by mass or less, still further preferably 12% by mass or less, and still more further preferably 11% by mass or less.

The upper limit values and the lower limit values of these numerical ranges may be optionally combined. Specifically, the content thereof is preferably 0.5% by mass to less than 15% by mass, more preferably 1.0% by mass to 14% by mass, further preferably 2.0% by mass to 13% by mass, still further preferably 3.0% by mass to 12% by mass, still more further preferably 4.0% by mass to 11% by mass, and still more further preferably 4.5% by mass to 11% by mass.

In the case where the oxygen-containing synthetic oil (A2) is the polyol ester, the content of the oxygen-containing synthetic oil (A2) based on the total amount of the lubricating oil composition is preferably 0.5% by mass or more, more preferably 1.0% by mass or more, further preferably 2.0% by mass or more, further preferably 3.0% by mass or more, still further preferably 4.0% by mass or more, and still more further preferably 4.5% by mass or more. The content thereof is preferably less than 15% by mass, more preferably 14% by mass or less, further preferably 13% by mass or less, still further preferably 12% by mass or less, and still more further preferably 11% by mass or less.

The upper limit values and the lower limit values of these numerical ranges may be optionally combined. Specifically, the content thereof is preferably 0.5% by mass to less than 15% by mass, more preferably 1.0% by mass to 14% by mass, further preferably 2.0% by mass to 13% by mass, still further preferably 3.0% by mass to 12% by mass, still more further preferably 4.0% by mass to 11% by mass, and still more further preferably 4.5% by mass to 11% by mass.

In the case where the oxygen-containing synthetic oil (A2) is the ether oil, the content of the oxygen-containing synthetic oil (A2) based on the total amount of the lubricating oil composition is preferably 0.5% by mass or more, more preferably 1.0% by mass or more, further preferably 2.0% by mass or more, further preferably 3.0% by mass or more, still further preferably 4.0% by mass or more, and still more further preferably 4.5% by mass or more. The content thereof is preferably less than 15% by mass, more preferably 14% by mass or less, further preferably 13% by mass or less, still further preferably 12% by mass or less, and still more further preferably 11% by mass or less.

The upper limit values and the lower limit values of these numerical ranges may be optionally combined. Specifically, the content thereof is preferably 0.5% by mass to less than 15% by mass, more preferably 1.0% by mass to 14% by mass, further preferably 2.0% by mass to 13% by mass, still further preferably 3.0% by mass to 12% by mass, still more further preferably 4.0% by mass to 11% by mass, and still more further preferably 4.5% by mass to 11% by mass.

In the case where the oxygen-containing synthetic oil (A2) is the alcohol oil, the content of the oxygen-containing synthetic oil (A2) based on the total amount of the lubricating oil composition is preferably 0.5% by mass or more, more preferably 1.0% by mass or more, further preferably 2.0% by mass or more, further preferably 3.0% by mass or more, still further preferably 4.0% by mass or more, and still more further preferably 4.5% by mass or more. The content thereof is preferably less than 15% by mass, more preferably 14% by mass or less, further preferably 13% by mass or less, still further preferably 12% by mass or less, and still more further preferably 11% by mass or less.

The upper limit values and the lower limit values of these numerical ranges may be optionally combined. Specifically, the content thereof is preferably 0.5% by mass to less than 15% by mass, more preferably 1.0% by mass to 14% by mass, further preferably 2.0% by mass to 13% by mass, still further preferably 3.0% by mass to 12% by mass, still more further preferably 4.0% by mass to 11% by mass, and still more further preferably 4.5% by mass to 11% by mass.

<Content Ratio of Mineral Oil (A1) and Oxygen-Containing Synthetic Oil (A2)>

In the lubricating oil composition according to one embodiment of the present invention, the content ratio ((A1)/(A2)) in terms of mass ratio of the mineral oil (A1) and the oxygen-containing synthetic oil (A2) is preferably 3.0 to 20.0, more preferably 4.0 to 20.0, further preferably 5.0 to 18.0, and still further preferably 6.0 to 17.0, from the standpoint of further facilitating the exertion of the effects of the present invention.

<Base Oil Other than Mineral Oil (A1) and Oxygen-Containing Synthetic Oil (A2)>

The lubricating oil composition according to one embodiment of the present invention may contain a base oil other than the mineral oil (A1) and the oxygen-containing synthetic oil (A2) in such a range that largely does not impair the effects of the present invention.

Examples of the base oil include a non-oxygen-containing synthetic oil (A2'), such as a poly-α-olefin.

In the description herein, the term "non-oxygen-containing" in the "non-oxygen-containing synthetic oil" means that no oxygen atom exists in the molecule constituting the synthetic oil.

In the lubricating oil composition according to one embodiment of the present invention, the content of the non-oxygen-containing synthetic oil (A2') is preferably small from the standpoint of facilitating the enhancement of the viscosity index of the lubricating oil composition.

Specifically, the content of the non-oxygen-containing synthetic oil (A2') is preferably 10 parts by mass or less, more preferably 5.0 parts by mass or less, further preferably 1.0 part by mass or less, and still further preferably 0.1 part by mass or less, per 100 parts by mass of the oxygen-containing synthetic oil (A2).

[Viscosity Index Improver (B)]

The lubricating oil composition of the present invention contains a viscosity index improver (B).

The viscosity index improver (B) contains a comb-shaped polymer (B1).

The content ratio ((A2)/(B1)) in terms of mass ratio of the oxygen-containing synthetic oil (A2) and the comb-shaped polymer (B1) is preferably 10.0 or less.

The content of the comb-shaped polymer (B1) for calculating the ratio ((A2)/(B1)) means the content of the comb-shaped polymer (B) in terms of resin content.

The ratio ((A2)/(B1)) that is 10.0 or less can facilitate the reduction of the viscosity of the lubricating oil composition in the low temperature range.

The content ratio ((A2)/(B1)) of the oxygen-containing synthetic oil (A2) and the comb-shaped polymer (B1) is preferably 9.0 or less, more preferably 8.5 or less, further preferably 8.0 or less, still further preferably 7.5 or less, still more further preferably 7.0 or less, still more further preferably 6.0 or less, and still more further preferably 5.0 or less, from the standpoint further facilitating the reduction of the viscosity of the lubricating oil composition in the low temperature range. The content ratio thereof is preferably 1.0 or more.

In the lubricating oil composition according to one embodiment of the present invention, the viscosity index improver (B) may be constituted only by the comb-shaped polymer (B1), and may contain a viscosity index improver other than the comb-shaped polymer (B1) in such a range that does not deviate from the spirit of the present invention.

In the lubricating oil composition according to one embodiment of the present invention, the content of the resin content of the comb-shaped polymer (B1) based on the total amount of the resin content of the viscosity index improver (B) is preferably 70% by mass to 100% by mass, more preferably 80% by mass to 100% by mass, further preferably 90% by mass to 100% by mass, still further preferably 95% by mass to 100% by mass, and still more further preferably 99% by mass to 100% by mass.

However, in the lubricating oil composition according to one embodiment of the present invention, the resin content of one or more kind of a polymethacrylate (B2) selected from the group consisting of a non-dispersive polymethacrylate and a dispersive polymethacrylate is preferably small from the standpoint of facilitating the exertion of the effects of the present invention by suppressing the effect of increasing the viscosity with the viscosity index improver.

Specifically, the resin content of the polymethacrylate (B2) is preferably 10 parts by mass or less, more preferably 5.0 parts by mass or less, further preferably 1.0 part by mass or less, and still further preferably 0.1 part by mass or less, per 100 parts by mass of the resin content of the comb-shaped polymer (B1).

<Comb-Shaped Polymer (B1)>

The comb-shaped polymer (B1) will be described in detail below.

In the present invention, the "comb-shaped polymer (B1)" means a polymer having a structure with a main chain having multiple trident points, from each of which a high molecular weight side chain is branched.

The mass average molecular weight (Mw) of the comb-shaped polymer (B1) is preferably 100,000 to 1,000,000, more preferably 150,000 to 800,000, and further preferably 200,000 to 700,000, from the standpoint of enhancing the fuel saving capability.

The molecular weight distribution (Mw/Mn) of the comb-shaped polymer (B1) (in which Mw represents the mass average molecular weight of the comb-shaped polymer (B1), and Mn represents the number average molecular weight of the comb-shaped polymer (B1)) is preferably 8.00 or less, more preferably 7.00 or less, further preferably 6.50 or less, still further preferably 6.00 or less, still more further preferably 5.00 or less, and still more further preferably 3.00 or less, from the standpoint of enhancing the fuel saving capability of the lubricating oil composition. There is a tendency that with a smaller molecular weight distribution of the comb-shaped polymer (B1), the fuel saving capability of the lubricating oil composition containing both the comb-shaped polymer (B1) and the base oil (A) is enhanced.

The lower limit value of the molecular weight distribution of the comb-shaped polymer (B1) is not particularly limited, and is generally 1.01 or more, preferably 1.05 or more, and more preferably 1.10 or more.

In the lubricating oil composition according to one embodiment of the present invention, the resin content of the comb-shaped polymer (B1) is not particularly limited, and may satisfy the requirement of the content ratio ((A2)/(B1)) of the oxygen-containing synthetic oil (A2) and the comb-shaped polymer (B1), and is preferably 0.5% by mass to 5.0% by mass, more preferably 0.8% by mass to 4.0% by mass, and further preferably 1.0% by mass to 3.5% by mass, based on the total amount of the lubricating oil composition, from the standpoint of facilitating the exertion of the effects of the present invention.

The PSSI (permanent shear stability index) of the comb-shaped polymer (B1) is preferably 12.0 or less, more preferably 10.0 or less, further preferably 5.0 or less, still further preferably 3.0 or less, and particularly preferably 1.0 or less.

The lower limit value of the PSSI of the comb-shaped polymer (B1) is not particularly limited, and is generally 0.1 or more, and preferably 0.2 or more.

In the description herein, the PSSI (permanent shear stability index) of the viscosity index improver is a value that shows the viscosity reduction in terms of percentage derived from the resin content in the viscosity index improver, and is a value that is calculated according to ASTM D6022-06. More specifically, the value is calculated according to the following calculation expression.

$$PSSI = \frac{K_{V0} - K_{V1}}{K_{V0} - K_{Voil}} \times 100$$

In the calculation expression, $Kv_0$ represents the value of the kinematic viscosity at 100° C. of the specimen oil obtained by diluting the viscosity index improver containing the resin content with a mineral oil, $Kv_1$ represents the value of the kinematic viscosity at 100° C. of the specimen oil obtained by diluting the viscosity index improver containing the resin content with a mineral oil having been passed through a high shear diesel injector by 30 cycles according to the procedure of ASTM D6278, and $Kv_{oil}$ represents value of the kinematic viscosity at 100° C. of the mineral oil used in diluting the viscosity index improver.

The value of the PSSI of the comb-shaped polymer (B1) varies depending on the structure of the comb-shaped polymer (B1). Specifically, there are the following tendencies, and the value of the PSSI of the comb-shaped polymer (B1) can be easily regulated in consideration of these aspects. The following aspects are just one example and the value can be also regulated in consideration of the aspects other than these aspects.

- In the case where the side chain of the comb-shaped polymer (B1) is constituted by a macromonomer (x1), the content of a structural unit (X1) derived from the macromonomer (x1) is 0.5% by mol or more based on the total structural units, the value of the PSSI of the comb-shaped polymer tends to decrease.
- In the case where the molecular weight of the macromonomer (x1) constituting the side chain of the comb-shaped polymer (B1) is increased, the value of the PSSI thereof tends to decrease.

<Structural Unit of Comb-Shaped Polymer (B1)>

The structural unit of the comb-shaped polymer (B1) used in one embodiment of the present invention will be described.

The comb-shaped polymer (B1) is preferably a polymer containing at least a structural unit (X1) derived from a macromonomer (x1). The structural unit (X1) corresponds to the "high molecular weight side chain" described above.

In the present invention, the "macromonomer" means a high molecular weight monomer having a polymerizable functional group, and is preferably a high molecular weight monomer having a polymerizable functional group at an end thereof.

The comb-shaped polymer (B1) that has the relatively longer main chain with respect to the side chain has a lower shear stability. This characteristic feature is considered to contribute to the enhancement of the fuel saving capability even in the low temperature range around 40° C.

In the comb-shaped polymer (B1) used in one embodiment of the present invention, the content of the structural unit (X1) is preferably 0.1% by mol or more, more preferably 0.3% by mol or more, and further preferably 0.5% by mol or more, based on the total structural units of the comb-shaped polymer (B1), from the aforementioned standpoint. The content thereof is preferably 20% by mol or less, more preferably 17% by mol or less, and further preferably 15% by mol or less.

The upper limit values and the lower limit values of these numerical ranges may be optionally combined. Specifically, the content thereof is preferably 0.1% by mol to 20% by mol, more preferably 0.3% by mol to 17% by mol, and further preferably 0.5% by mol to 15% by mol.

In the description herein, the contents of the structural units in the comb-shaped polymer (B1) each mean a value that is calculated through the $^{13}$C-NMR quantitative spectrum analysis.

The number average molecular weight (Mn) of the macromonomer (x1) is preferably 300 or more, more preferably 500 or more, further preferably 1,000 or more, still further preferably 2,000 or more, and particularly preferably 4,000 or more, and is preferably 100,000 or less, more preferably 50,000 or less, further preferably 20,000 or less, and further preferably 10,000 or less, from the aforementioned standpoint.

Examples of the polymerizable functional group that the macromonomer (x1) has include an acryloyl group ($CH_2$═CH—COO—), a methacryloyl group ($CH_2$═$CCH_3$—COO—), an ethenyl group ($CH_2$═CH—), a vinyl ether group ($CH_2$═CH—O—), an allyl group ($CH_2$═CH—$CH_2$—), an allyl ether group ($CH_2$═CH—$CH_2$—O—), a group represented by $CH_2$═CH—CONH—, and a group represented by $CH_2$═$CCH_3$—CONH—. Among these, an acryloyl group ($CH_2$═CH—COO—) and a methacryloyl group ($CH_2$═$CCH_3$—COO—) are preferred, and a methacryloyl group ($CH_2$═$CCH_3$—COO—) is more preferred.

The macromonomer (x1) may have, for example, one or more kind of the repeating units represented by the following general formulae (i) to (iii), in addition to the polymerizable functional group.

(i)

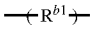

(ii)

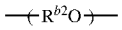

(iii)

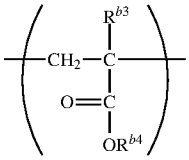

In the general formula (i), $R^{b1}$ represents a linear or branched alkylene group having 1 to 10 carbon atoms, and specific examples thereof include a methylene group, an ethylene group, a 1,2-propylene group, a 1,3-propylene group, a 1,2-butylene group, a 1,3-butylene group, a 1,4-butylene group, a pentylene group, a hexylene group, a heptylene group, an octylene group, a nonylene group, a decylene group, and a 2-ethylhexylene group.

In the general formula (ii), $R^{b2}$ represents a linear or branched alkylene group having 2 to 4 carbon atoms, and specific examples thereof include an ethylene group, a 1,2-propylene group, a 1,3-propylene group, a 1,2-butylene group, a 1,3-butylene group, and a 1,4-butylene group.

In the general formula (iii), $R^{b3}$ represents a hydrogen atom or a methyl group.

$R^{b4}$ represents a linear or branched alkyl group having 1 to 10 carbon atoms, and specific examples thereof include a methyl group, an ethyl group, a n-propyl group, a n-butyl group, a n-pentyl group, a n-hexyl group, a n-heptyl group, a n-octyl group, a n-nonyl group, a n-decyl group, an isopropyl group, an isobutyl group, a sec-butyl group, a t-butyl group, an isopentyl group, a t-pentyl group, an isohexyl group, a t-hexyl group, an isoheptyl group, a t-heptyl group, a 2-ethylhexyl group, an isooctyl group, an isononyl group, and an isodecyl group.

In the case where multiple repeating units represented by each of the general formulae (i) to (iii) exist, $R^{b1}$, $R^{b2}$, $R^{b3}$, and $R^{b4}$ each may be the same as or different from each other.

In one embodiment of the present invention, the macromonomer (x1) is preferably a polymer having a repeating unit represented by the general formula (i), and more preferably a polymer having a repeating unit (X1-1) represented by the general formula (i) in which $R^{b1}$ represents a 1,2-butylene group and/or a 1,4-butylene group.

The content of the repeating unit (X1-1) is preferably 1 to 100% by mol, more preferably 20 to 95% by mol, further preferably 40 to 90% by mol, and still further preferably 50 to 80% by mol, based on the total amount (100% by mol) of the structural units of the macromonomer (x1).

In the case where the macromonomer (x1) is a copolymer having two or more kinds of repeating units selected from the repeating units represented by the general formulae (i) to (iii), the mode of the copolymerization may be either a block copolymer or a random copolymer.

The comb-shaped polymer (B1) used in one embodiment of the present invention may be a homopolymer containing only the structural unit (X1) derived from one kind of the macromonomer (x1), and may be a copolymer containing structural units (X1) derived from two or more kinds of the macromonomers (x1). The comb-shaped polymer (B1) used in one embodiment of the present invention may be a copolymer containing a structural unit (X2) derived from a monomer (x2) other than the macromonomer (x1), in addition to the structural unit derived from the macromonomer (x1).

The comb-shaped polymer (B1) is preferably a copolymer containing a structural unit (X2) derived from a monomer (x2) other than the macromonomer (x1), in addition to the structural unit derived from the macromonomer (x1), from the standpoint of facilitating the reduction of the viscosity of the lubricating oil composition in the low temperature range and facilitating the increase of the viscosity thereof in the high temperature range.

The specific structure of the comb-shaped polymer (B1) of this type is preferably a copolymer having a main chain containing the structural unit (X2) derived from the monomer (x2) and a side chain containing the structural unit (X1) derived from the macromonomer (x1). A copolymer containing a main chain containing the structural unit (X2) derived from the monomer (x2) in which the main chain also contains the structural unit (X1) derived from the macromonomer (x1) is more preferred.

Examples of the monomer (x2) include a monomer (x2-a) represented by the following general formula (a1), an alkyl (meth)acrylate (x2-b), a nitrogen atom-containing vinyl monomer (x2-c), a hydroxy group-containing vinyl monomer (x2-d), a phosphorus atom-containing monomer (x2-e), an aliphatic hydrocarbon-based vinyl monomer (x2-f), an alicyclic hydrocarbon-based vinyl monomer (x2-g), a vinyl ester compound (x2-h), a vinyl ether compound (x2-i), a vinyl ketone compound (x2-j), an epoxy group-containing vinyl monomer (x2-k), a halogen element-containing vinyl monomer (x2-l), an ester of an unsaturated polycarboxylic acid (x2-m), a (di)alkyl fumarate (x2-n), a (di)alkyl maleate (x2-o), and an aromatic hydrocarbon-based vinyl monomer (x2-p).

The monomer (x2) is preferably a monomer other than the nitrogen atom-containing vinyl monomer (x2-c), the phosphorus atom-containing monomer (x2-e), and the aromatic hydrocarbon-based vinyl monomer (x2-p).

The monomer (x2) preferably contains one or more kind selected from the monomer (x2-a) represented by the following general formula (a1), the alkyl (meth)acrylate (x2-b), and the hydroxy group-containing vinyl monomer (x2-d), and more preferably contains at least the hydroxy group-containing vinyl monomer (x2-d).

The monomer (x2) preferably contains the alkyl (meth) acrylate (x2-b). The amounts of the monomer (x2-a) represented by the following general formula (a1) and the hydroxy group-containing vinyl monomer (x2-d) are preferably small from the standpoint of further enhancing the effects of the present invention.

The content of the structural units derived from the monomer (x2-a) represented by the following general formula (a1) and the hydroxy group-containing vinyl monomer (x2-d) is preferably 12% by mol or less, more preferably 10% by mol or less, further preferably 5% by mol or less, still further preferably less than 1.0% by mol, still more further preferably less than 0.5% by mol, still more further preferably less than 0.1% by mol, still more further preferably less than 0.01% by mol, and particularly preferably 0% by mol, based on the total amount (100% by mass) of the structural units of the comb-shaped polymer.

(Monomer (x2-a) Represented by General Formula (A1))

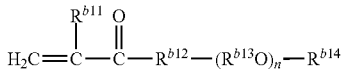

(a1)

In the general formula (a1), $R^{b11}$ represents a hydrogen atom or a methyl group.

$R^{b12}$ represents a single bond, a linear or branched alkylene group having 1 to 10 carbon atoms, —O—, or —NH—.

$R^{b13}$ represents a linear or branched alkylene group having 2 to 4 carbon atoms. n represents an integer of 1 or more (preferably an integer of 1 to 20, and more preferably an integer of 1 to 5). In the case where n represents an integer of 2 or more, multiple groups represented by $R^{b13}$ may be the same as or different from each other, and the $(R^{b13}O)_n$ moiety may be either a random bond or a block bond.

$R^{b14}$ represents a linear or branched alkyl group having 1 to 60 (preferably 10 to 50, and more preferably 20 to 40) carbon atoms.

Specific examples of the groups for the "linear or branched alkylene group having 1 to 10 carbon atoms", the "linear or branched alkylene group having 2 to 4 carbon atoms", and the "linear or branched alkyl group having 1 to 60 carbon atoms" include the same groups as exemplified in the description relating to the general formulae (i) to (iii).

Alkyl (Meth)acrylate (x2-b)

Examples of the alkyl (meth)acrylate (x2-b) include methyl (meth)acrylate, ethyl (meth)acrylate, n-propyl (meth)acrylate, isopropyl (meth)acrylate, n-butyl (meth) acrylate, t-butyl (meth)acrylate, pentyl (meth)acrylate, hexyl (meth)acrylate, 2-ethylhexyl (meth)acrylate, heptyl (meth) acrylate, 2-t-butylheptyl (meth)acrylate, octyl (meth)acrylate, and 3-isopropylheptyl (meth)acrylate.

The number of carbon atoms of the alkyl group that the alkyl (meth)acrylate (x2-b) has is preferably 4 to 30, more preferably 4 to 24, and further preferably 4 to 18.

The alkyl group may be either a linear alkyl group or a branched alkyl group.

The content ratio ((α)/(β)) in terms of molar ratio of a structural unit (α) derived from butyl (meth)acrylate and a structural unit (β) derived from an alkyl (meth)acrylate having an alkyl group having 12 to 20 carbon atoms is preferably 5.00 or more, more preferably 7.00 or more, further preferably 8.50 or more, and still further preferably 10.00 or more, and is preferably 20 or less, and more preferably 15 or less.

The content of the structural unit (α) derived from butyl (meth)acrylate is preferably 40 to 95% by mol, more preferably 50 to 90% by mol, and further preferably 60 to 85% by mol, based on the total amount (100% by mol) of the structural units of the comb-shaped polymer.

The content of the structural unit (β) derived from an alkyl (meth)acrylate having an alkyl group having 12 to 20 carbon atoms is preferably 1 to 30% by mol, more preferably 3 to 25% by mol, and further preferably 5 to 20% by mol, based on the total amount (100% by mol) of the structural units of the comb-shaped polymer.

(Nitrogen Atom-Containing Vinyl Monomer (x2-c))

Examples of the nitrogen atom-containing vinyl monomer (x2-c) include an amide group-containing vinyl monomer (x2-c1), a nitro group-containing monomer (x2-c2), a primary amino group-containing vinyl monomer (x2-c3), a secondary amino group-containing vinyl monomer (x2-c4), a tertiary amino group-containing vinyl monomer (x2-c5), and a nitrile group-containing vinyl monomer (x2-c6).

Examples of the amide group-containing vinyl monomer (x2-c1) include (meth)acrylamide; a monoalkylamino (meth)acrylamide, such as N-methyl (meth)acrylamide, N-ethyl (meth)acrylamide, N-isopropyl (meth)acrylamide, N-n-butyl (meth)acrylamide, and N-isobutyl (meth)acrylamide; a monoalkylaminoalkyl (meth)acrylamide, such as N-methylaminoethyl (meth)acrylamide, N-ethylaminoethyl (meth)acrylamide, N-isopropylamino-n-butyl (meth)acrylamide, N-n-butylamino-n-butyl (meth)acrylamide, and N-isobutylamino-n-butyl (meth)acrylamide; a dialkylamino (meth)acrylamide, such as N,N-dimethyl (meth)acrylamide, N,N-diethyl (meth)acrylamide, N,N-diisopropyl (meth) acrylamide, and N,N-di-n-butyl (meth)acrylamide; a dialkylaminoalkyl (meth)acrylamide, such as N, N-dimethylaminoethyl (meth)acrylamide, N,N-diethylaminoethyl (meth) acrylamide, N, N-dimethylaminopropyl (meth)acrylamide, and N, N-di-n-butylaminobutyl (meth)acrylamide; and an N-vinylcarboxylic acid amide, such as N-vinylformamide, N-vinylacetamide, N-vinyl-n-propionylamide, N-vinylisopropionylamide, and N-vinylhydroxyacetamide.

Examples of the nitro group-containing monomer (x2-c2) include nitroethylene and 3-nitro-1-propene.

Examples of the primary amino group-containing vinyl monomer (x2-c3) include an alkenylamine having an alkenyl group having 3 to 6 carbon atoms, such as (meth) allylamine and crotylamine; and an aminoalkyl (meth)acrylate having an alkyl group having 2 to 6 carbon atoms, such as aminoethyl (meth)acrylate.

Examples of the secondary amino group-containing vinyl monomer (x2-c4) include a monoalkylaminoalkyl (meth) acrylate, such as t-butylaminoethyl (meth)acrylate and methylaminoethyl (meth)acrylate; and a dialkenylamine having 6 to 12 carbon atoms, such as di(meth)allylamine.

Examples of the tertiary amino group-containing vinyl monomer (x2-c5) include a dialkylaminoalkyl (meth)acrylate, such as dimethylaminoethyl (meth)acrylate and diethylaminoethyl (meth)acrylate; an alicyclic (meth)acrylate having a nitrogen atom, such as morpholinoethyl (meth) acrylate; and a hydrochloride, a sulfate, a phosphate, or a lower alkyl (having 1 to 8 carbon atoms) monocarboxylate (such as a acetate and a propionate) thereof.

Examples of the nitrile group-containing vinyl monomer (x2-c6) include (meth)acrylonitrile.

In the comb-shaped polymer used in one embodiment of the present invention, the content of the structural unit derived from the nitrogen atom-containing vinyl monomer (x2-c) is preferably as small as possible.

The specific content of the structural unit derived from the nitrogen atom-containing vinyl monomer (x2-c) is preferably less than 1.0% by mol, more preferably less than 0.5% by mol, further preferably less than 0.1% by mol, still further preferably less than 0.01% by mol, and particularly preferably 0% by mol, based on the total amount (100% by mol) of the structural units of the comb-shaped polymer.

(Hydroxy Group-Containing Vinyl Monomer (x2-d))

Examples of the hydroxy group-containing vinyl monomer (x2-d) include a hydroxy group-containing vinyl monomer (x2-d1) and a polyoxyalkylene chain-containing vinyl monomer (x2-d2).

Examples of the hydroxy group-containing vinyl monomer (x2-d1) include a hydroxyalkyl (meth)acrylate having an alkyl group having 2 to 6 carbon atoms, such as 2-hydroxyethyl (meth)acrylate and 2- or 3-hydroxypropyl (meth) acrylate; a mono- or dihydroxyalkyl-substituted (meth)acrylamide having an alkyl group having 1 to 4 carbon atoms, such as N,N-dihydroxymethyl (meth)acrylamide, N,N-dihydroxypropyl (meth)acrylamide, and N, N-di-2-hydroxybutyl (meth)acrylamide; vinyl alcohol; an alkenol having 3 to 12 carbon atoms, such as (meth)allyl alcohol, crotyl alcohol, isocrotyl alcohol, 1-octenol, and 1-undecenol; an alkenemonool or an alkenediol having 4 to 12 carbon atoms, such as 1-butene-3-ol, 2-butene-1-ol, and 2-butene-1,4-diol; a hydroxyalkyl alkenyl ether having an alkyl group having 1 to 6 carbon atoms and an alkenyl group having 3 to 10 carbon atoms, such as 2-hydroxyethyl propenyl ether; a compound having a polyhydric alcohol, such as glycerin, pentaerythritol, sorbitol, sorbitan, diglycerin, a sugar, and sucrose, having introduced thereto an unsaturated group, such as an alkenyl group and the polymerizable functional group that the macromonomer (x1) has; and a compound having glyceric acid or a glycerin fatty acid ester, having introduced thereto an unsaturated group, such as an alkenyl group and the polymerizable functional group that the macromonomer (x1) has.

Among these, a hydroxy group-containing vinyl monomer having two or more hydroxy groups is preferred, and a compound having a polyhydric alcohol or glyceric acid, having introduced thereto the unsaturated group is more preferred.

Examples of the polyoxyalkylene chain-containing vinyl monomer (x2-d2) include a polyoxyalkylene glycol (having a number of carbon atoms of the alkylene group of 2 to 4 and a polymerization degree of 2 to 50), a polyoxyalkylenepolyol (a polyoxyalkylene ether of the polyhydric alcohol (having a number of carbon atoms of the alkylene group of 2 to 4 and a polymerization degree of 2 to 100), and a compound selected from an alkyl (having 1 to 4 carbon atoms) ether of a polyoxyalkylene glycol or a polyoxyalkylenepolyol, having introduced thereto the unsaturated group.

Specific examples thereof include polyethylene glycol (Mn: 100 to 300) mono(meth)acrylate, polypropylene glycol (Mn: 130 to 500) mono(meth)acrylate, methoxypolyethylene glycol (Mn: 110 to 310) (meth)acrylate, lauryl alcohol ethylene oxide adduct (2 to 30 mol) (meth)acrylate, and polyoxyethylene (Mn: 150 to 230) sorbitan mono(meth) acrylate.

(Phosphorus Atom-Containing Monomer (x2-e))

Examples of the phosphorus atom-containing monomer (x2-e) include a phosphate ester group-containing monomer (x2-e1) and a phosphono group-containing monomer (x2-e2).

Examples of the phosphate ester group-containing monomer (x2-e1) include a (meth)acryloyloxyalkyl phosphate ester having an alkyl group having 2 to 4 carbon atoms, such as (meth)acryloyloxyethyl phosphate and (meth)acryloyloxyisopropyl phosphate; and an alkenyl phosphate ester having an alkenyl group having 2 to 12 carbon atoms, such as vinyl phosphate, allyl phosphate, propenyl phosphate, isopropenyl phosphate, butenyl phosphate, pentenyl phosphate, octenyl phosphate, decenyl phosphate, and dodecenyl phosphate.

Examples of the phosphono group-containing monomer (x2-e2) include a (meth)acryloyloxyalkyl phosphonate having an alkyl group having 2 to 4 carbon atoms, such as (meth)acryloyloxyethyl phosphonate; an alkenyl phosphonate having an alkenyl group having 2 to 12 carbon atoms, such as vinyl phosphonate, allyl phosphonate, and octenyl phosphonate.

In the comb-shaped polymer used in one embodiment of the present invention, the content of the structural unit derived from the phosphorus atom-containing monomer (x2-e) is preferably as small as possible.

The specific content of the structural unit derived from the phosphorus atom-containing monomer (x2-e) is preferably less than 1.0% by mol, more preferably less than 0.5% by mol, further preferably less than 0.1% by mol, still further preferably less than 0.01% by mol, and particularly preferably 0% by mol, based on the total amount (100% by mol) of the structural units of the comb-shaped polymer.

(Aliphatic Hydrocarbon-Based Vinyl Monomer (x2-f))

Examples of the aliphatic hydrocarbon-based vinyl monomer (x2-f) include an alkene having 2 to 20 carbon atoms, such as ethylene, propylene, butene, isobutylene, pentene, heptene, diisobutylene, octene, dodecene, and octadecene; and an alkadiene having 4 to 12 carbon atoms, such as butadiene, isoprene, 1,4-pentadiene, 1,6-heptadiene, and 1,7-octadiene.

The number of carbon atoms of the aliphatic hydrocarbon-based vinyl monomer (x2-f) is preferably 2 to 30, more preferably 2 to 20, and further preferably 2 to 12.

(Alicyclic Hydrocarbon-Based Vinyl Monomer (x2-g))

Examples of the alicyclic hydrocarbon-based vinyl monomer (x2-g) include cyclohexene, (di)cyclopentadiene, pinene, limonene, vinylcyclohexene, and ethylidenebicycloheptene.

The number of carbon atoms of the alicyclic hydrocarbon-based vinyl monomer (x2-g) is preferably 3 to 30, more preferably 3 to 20, and further preferably 3 to 12.

(Vinyl Ester Compound (x2-h))

Examples of the vinyl ester compound (x2-h) include a vinyl ester of a saturated fatty acid having 2 to 12 carbon atoms, such as vinyl acetate, vinyl propionate, vinyl butyrate, and vinyl octanoate.

(Vinyl Ether Compound (x2-i))

Examples of the vinyl ether compound (x2-i) include an alkyl vinyl ether having 1 to 12 carbon atoms, such as methyl vinyl ether, ethyl vinyl ether, propyl vinyl ether, butyl vinyl ether, and 2-ethylhexyl vinyl ether; and an alkoxyalkyl vinyl ether having 1 to 12 carbon atoms, such as vinyl 2-methoxyethyl ether and vinyl 2-butoxyethyl ether.

(Vinyl Ketone Compound (x2-j))

Examples of the vinyl ketone compound (x2-j) include an alkyl vinyl ketone having 1 to 8 carbon atoms, such as methyl vinyl ketone and ethyl vinyl ketone.

(Epoxy Group-Containing Vinyl Monomer (x2-k))

Examples of the epoxy group-containing vinyl monomer (x2-k) include glycidyl (meth)acrylate and glycidyl (meth) allyl ether.

(Halogen Element-Containing Vinyl Monomer (x2-l))

Examples of the halogen element-containing vinyl monomer (x2-l) include vinyl chloride, vinyl bromide, vinylidene chloride, and (meth)allyl chloride.

(Ester of Unsaturated Polycarboxylic Acid (x2-m))

Examples of the ester of an unsaturated polycarboxylic acid (x2-m) include an alkyl ester of an unsaturated polycarboxylic acid, a cycloalkyl ester of an unsaturated polycarboxylic acid, and an aralkyl ester of an unsaturated polycarboxylic acid, and examples of the unsaturated polycarboxylic acid include maleic acid, fumaric acid, and itaconic acid.

In the comb-shaped polymer used in one embodiment of the present invention, the content of the structural units derived from the vinyl ester compound (x2-h), the vinyl ether compound (x2-i), the vinyl ketone compound (x2-j), the epoxy group-containing vinyl monomer (x2-k), and the halogen element-containing vinyl monomer (x2-l) is preferably as small as possible.

The specific content of the structural units derived from these monomers is preferably less than 1.0% by mol, more preferably less than 0.5% by mol, further preferably less than 0.1% by mol, still further preferably less than 0.01% by mol, and particularly preferably 0% by mol, based on the total amount (100% by mol) of the structural units of the comb-shaped polymer.

((Di)Alkyl Fumarate (x2-n))

Examples of the (di)alkyl fumarate (x2-n) include monomethyl fumarate, dimethyl fumarate, monoethyl fumarate, diethyl fumarate, methyl ethyl fumarate, monobutyl fumarate, dibutyl fumarate, dipentyl fumarate, and dihexyl fumarate.

((Di)alkyl Maleate (x2-o))

Examples of the (di)alkyl maleate (x2-o) include monomethyl maleate, dimethyl maleate, monoethyl maleate, diethyl maleate, methyl ethyl maleate, monobutyl maleate, and dibutyl maleate.

In the comb-shaped polymer (B1) used in one embodiment of the present invention, the content of the structural units derived from the (di)alkyl maleate (x2-o) and the (di)alkyl fumarate (x2-n) is preferably as small as possible.

The specific content of the structural units derived from these monomers is preferably less than 1.0% by mol, more preferably less than 0.5% by mol, further preferably less than 0.1% by mol, still further preferably less than 0.01% by mol, and particularly preferably 0% by mol, based on the total amount (100% by mol) of the structural units of the comb-shaped polymer.

(Aromatic Hydrocarbon-Based Vinyl Monomer (x2-p))

Examples of the aromatic hydrocarbon-based vinyl monomer (x2-p) include styrene, α-methylstyrene, α-ethylstyrene, vinyltoluene, 2,4-dimethylstyrene, 4-ethylstyrene, 4-isopropylstyrene, 4-butylstyrene, 4-phenylstyrene, 4-cyclohexylstyrene, 4-benzylstyrene, p-methylstyrene, monochlorostyrene, dichlorostyrene, tribromostyrene, tetrabromostyrene, 4-crotylbenzene, indene, and 2-vinylnaphthalene.

The number of carbon atoms of the aromatic hydrocarbon-based vinyl monomer (x2-p) is preferably 8 to 30, more preferably 8 to 20, and further preferably 8 to 18.

In the comb-shaped polymer (B1) used in one embodiment of the present invention, the content of the structural unit derived from the aromatic hydrocarbon-based vinyl monomer (x2-p) is preferably as small as possible.

The specific content of the structural unit derived from aromatic hydrocarbon-based vinyl monomer (x2-p) is preferably less than 1.0% by mol, more preferably less than 0.5% by mol, further preferably less than 0.1% by mol, still further preferably less than 0.01% by mol, and particularly preferably 0% by mol, based on the total amount (100% by mol) of the structural units of the comb-shaped polymer.

[Additional Additives]

The lubricating oil composition according to one embodiment of the present invention may further contain an additional component other than the component (A) and the component (B) depending on necessity in such a range that does not deviate from the spirit of the present invention.

Examples of the additional component include additives for a lubricating oil having been generally used in lubricating oil compositions, and examples of the additives for a lubricating oil include one or more kind selected from the group consisting of a metal-based detergent, an anti-wear agent, an ashless dispersant, an extreme pressure agent, a pour point depressant, an antioxidant, an anti-foaming agent, a surfactant, a demulsifier, a friction modifier, an oiliness improver, a rust inhibitor, and a metal deactivator.

A compound having multiple functions as the additives for a lubricating oil (for example, a compound having functions of an anti-wear agent and an extreme pressure agent) may also be used.

One kind of each of the additives for a lubricating oil may be used alone, or two or more kinds thereof may be used in combination.

The contents of the additives for a lubricating oil each may be appropriately regulated in such a range that does not deviate from the spirit of the present invention. In the lubricating oil composition according to one embodiment of the present invention, the contents of the additives for a lubricating oil each are preferably 0.001 to 15% by mass, more preferably 0.005 to 10% by mass, and further preferably 0.01 to 8% by mass, based on the total amount of the lubricating oil composition.

In the case where the lubricating oil composition according to one embodiment of the present invention contains the additives for a lubricating oil, the total content thereof is preferably more than 0% by mass and 30% by mass or less, more preferably 0.001 to 25% by mass, further preferably 0.001 to 20% by mass, and still further preferably 0.001 to 15% by mass, based on the total amount of the lubricating oil composition.

<Metal-Based Detergent>

Examples of the metal-based detergent include an organic acid metal salt compound containing a metal atom selected from an alkali metal and an alkaline earth metal, and specific examples thereof include a metal salicylate, a metal phenate, and a metal sulfonate.

In the description herein, the "alkali metal" means lithium, sodium, potassium, rubidium, cesium, and francium.

The "alkaline earth metal" means beryllium, magnesium, calcium, strontium, and barium.

The metal atom contained in the metal-based detergent is preferably sodium, calcium, magnesium, or barium, and more preferably calcium, from the standpoint of enhancing the detergency at a high temperature.

The metal salicylate is preferably a compound represented by the following general formula (MD1), the metal phenate is preferably a compound represented by the following general formula (MD2), and the metal sulfonate is preferably a compound represented by the following general formula (MD3).

(MD1)

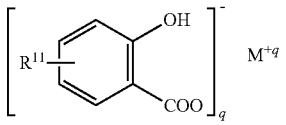

(MD2)

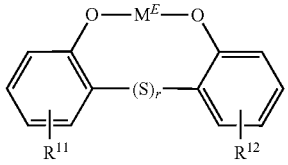

(MD3)

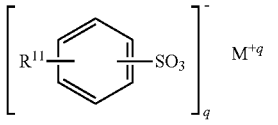

In the general formulae (MD1) to (MD3), M represents a metal atom selected from an alkali metal and an alkaline earth metal, in which sodium, calcium, magnesium, or barium is preferred, and calcium is more preferred. ME represents an alkaline earth metal, in which calcium, magnesium, or barium is preferred, and calcium is more preferred. q represents the valence of M, and is 1 or 2. $R^{11}$ and $R^{12}$ each independently represent a hydrogen atom or a hydrocarbon group having 1 to 18 carbon atoms. S represents a sulfur atom. r represents an integer of 0 or more, and preferably represents an integer of 0 to 3.

Examples of the hydrocarbon group that can be selected as $R^{11}$ and $R^{12}$ include an alkyl group having 1 to 18 carbon atoms, an alkenyl group having 1 to 18 carbon atoms, a cycloalkyl group having 3 to 18 ring carbon atoms, an aryl group having 6 to 18 ring carbon atoms, an alkylaryl group having 7 to 18 carbon atoms, and an arylalkyl group having 7 to 18 carbon atoms.

In one embodiment of the present invention, the metal-based detergent may be used alone or as a combination of two or more kinds thereof. Among these, one or more kind selected from calcium salicylate, calcium phenate, and calcium sulfonate is preferred from the standpoint of enhancing the detergency at a high temperature, and the standpoint of the solubility in the base oil.

In one embodiment of the present invention, the metal-based detergent may be either a neutral salt, a basic salt, an overbasic salt, and a mixture thereof.

The total base number of the metal-based detergent is preferably 0 to 600 mgKOH/g.

In one embodiment of the present invention, in the case where the metal-based detergent is a basic salt or an overbasic salt, the total base number of the metal-based detergent is preferably 10 to 600 mgKOH/g, and more preferably 20 to 500 mgKOH/g.

In the description herein, the "base number" means a base number by the perchloric acid method according to JIS K2501:2003 "Petroleum products and lubricants—Determination of neutralization number", Section 7.

In the case where the lubricating oil composition according to one embodiment of the present invention contains the metal-based detergent as the additional component, the content of the metal-based detergent is preferably 0.01 to 10% by mass based on the total amount (100% by mass) of the lubricating oil composition.

The metal-based detergent may be used alone or as a combination of two or more kinds thereof. The preferred total content in the case where two or more kinds thereof are used is the same as the content described above.

<Anti-Wear Agent>

Examples of the anti-wear agent include a sulfur-containing compound, such as zinc dialkyldithiophosphate (ZnDTP), zinc phosphate, a disulfide compound, sulfurized olefin compound, sulfurized fat and oil, a sulfurized ester compound, a thiocarbonate compound, a thiocarbamate compound, and a polysulfide compound; a phosphorus-containing compound, such as a phosphite ester compound, a phosphate ester compound, a phosphonate ester compound, and an amine salt or a metal salt thereof; and an anti-wear agent containing sulfur and phosphorus, such as a thiophosphite ester compound, a thiophosphate ester compound, a thiophosphonate ester compound, and an amine salt or a metal salt thereof.

Among these, zinc dialkyldithiophosphate (ZnDTP) is preferred.

In the case where the lubricating oil composition according to one embodiment of the present invention contains the anti-wear agent as the additional component, the content of the anti-wear agent is preferably 0.05 to 5.0% by mass based on the total amount (100% by mass) of the lubricating oil composition.

The anti-wear agent may be used alone or as a combination of two or more kinds thereof. The preferred total content in the case where two or more kinds thereof are used is the same as the content described above.

<Ashless Dispersant>

Examples of the ashless dispersant include a succinimide, a benzylamine, a succinate ester, and a boron-modified product thereof, and an alkenylsuccinimide and a boron-modified alkenylsuccinimide are preferred.

Examples of the alkenylsuccinimide include an alkenylsuccinmonoimide represented by the following general formula (i) and an alkenylsuccinbisimide represented by the following general formula (ii).

The alkenylsuccinimide may be a modified alkenylsuccinimide obtained by reacting the compound represented by the following general formula (i) or (ii) with one or more kind selected from an alcohol, an aldehyde, a ketone, an alkylphenol, a cyclic carbonate, an epoxy compound, an organic acid, and the like.

Examples of the boron-modified alkenylsuccinimide include a boron-modified product of the compound represented by the following general formula (AD1) or (AD2).

(AD1)

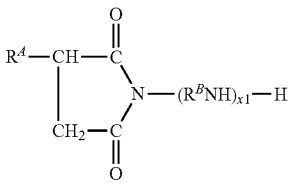

(AD2)

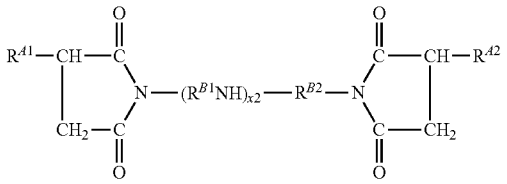

In the general formulae (AD1) and (AD2), $R^A$, $R^{A1}$, and $R^{A2}$ each independently represent an alkenyl group having a mass average molecular weight (Mw) of 500 to 3,000 (preferably 1,000 to 3,000), and a polybutenyl group or a polyisobutenyl group is preferred.

$R^B$, $R^{B1}$, and $R^{B2}$ each independently represent an alkylene group having 2 to 5 carbon atoms.

x1 represents an integer of 1 to 10, preferably an integer of 2 to 5, and more preferably 3 or 4.

x2 represents an integer of 0 to 10, preferably an integer of 1 to 4, and more preferably 2 or 3.

In one embodiment of the present invention, the ratio (B/N) of boron atoms and nitrogen atoms constituting the boron-modified alkenylsuccinimide is preferably 0.5 or more, more preferably 0.6 or more, further preferably 0.8 or more, and still further preferably 0.9 or more, from the standpoint of enhancing the detergency.

In the case where the lubricating oil composition according to one embodiment of the present invention contains the ashless dispersant as the additional component, the content of the ash-free dispersant is preferably 0.1 to 20% by mass based on the total amount (100% by mass) of the lubricating oil composition.

<Extreme Pressure Agent>

Examples of the extreme pressure agent include a sulfur-based extreme pressure agent, such as a sulfide compound, a sulfoxide compound, a sulfone compound, and a thiophosphonate compound, a halogen-based extreme pressure agent, such as a chlorinated hydrocarbon, and an organometallic extreme pressure agent. A compound that functions as an extreme pressure agent in the aforementioned anti-wear agents may also be used.

In one embodiment of the present invention, the extreme pressure agent may be used alone or as a combination of two or more kinds thereof.

In the case where the lubricating oil composition according to one embodiment of the present invention contains the extreme pressure agent as the additional component, the content of the extreme pressure agent is preferably 0.1 to 10% by mass based on the total amount of the lubricating oil composition.

<Antioxidant>

The antioxidant used may be a compound optionally selected from the known antioxidants having been used as an antioxidant for a lubricating oil, and examples thereof include an amine-based antioxidant, a phenol-based antioxidant, a molybdenum-based antioxidant, a sulfur-based antioxidant, and a phosphorus-based antioxidant.

Examples of the amine-based antioxidant include a diphenylamine-based antioxidant, such as diphenylamine and an alkylated diphenylamine having an alkyl group having 3 to 20 carbon atoms; and a naphthylamine-based antioxidant, such as α-naphthylamine, phenyl-α-naphthylamine, and a substituted phenyl-α-naphthylamine having an alkyl group having 3 to 20 carbon atoms.

Examples of the phenol-based antioxidant include a monophenol-based antioxidant, such as 2,6-di-tert-butylphenol, 2,6-di-tert-butyl-4-methylphenol, 2,6-di-tert-butyl-4-ethylphenol, isooctyl-3-(3,5-di-tert-butyl-4-hydroxyphenyl) propionate, and octadecyl-3-(3,5-di-tert-butyl-4-hydroxyphenyl) propionate; a diphenol-based antioxidant, such as 4,4'-methylenebis(2,6-di-tert-butylphenol) and 2,2'-methylenebis(4-ethyl-6-tert-butylphenol); and a hindered phenol-based antioxidant.

Examples of the molybdenum-based antioxidant include a molybdenum amine complex obtained by reacting molybdenum trioxide and/or molybdic acid with an amine compound.

Examples of the sulfur-based antioxidant include dilauryl 3,3'-dithiopropionate.

Examples of the phosphorus-based antioxidant include a phosphite. In the case where the phosphorus-based antioxidant is used, the amount thereof is preferably an amount that satisfies the preferred phosphorus atom content of the lubricating oil composition described later.

In one embodiment of the present invention, the antioxidant may be used alone or as a combination of two or more kinds thereof, and is preferably the phenol-based antioxidant and/or the amine-based antioxidant.

In the case where the lubricating oil composition according to one embodiment of the present invention contains the antioxidant as the additional component, the content of the antioxidant is preferably 0.05 to 7% by mass based on the total amount (100% by mass) of the lubricating oil composition.

<Pour Point Depressant>

Preferred examples of the pour point depressant include an ethylene-vinyl acetate copolymer, a condensate of chlorinated paraffin and naphthalene, a condensate of chlorinated paraffin and phenol, a polymethacrylate-based compound (PMA-based compound, such as a polyalkyl (meth)acrylate), a polyvinyl acetate, a polybutene, and a polyalkylstyrene, and a polymethacrylate-based compound is preferably used. The pour point depressant may be used alone or as a combination of two or more kinds thereof.

In the case where the lubricating oil composition according to one embodiment of the present invention contains the pour point depressant as the additional component, the content of the pour point depressant is preferably 0.01 to 10% by mass based on the total amount (100% by mass) of the lubricating oil composition.

<Anti-Foaming Agent>

Examples of the anti-foaming agent include a silicone oil, such as dimethylpolysiloxane, a fluorosilicone oil, and a fluoroalkyl ether. The anti-foaming agent may be used alone or as a combination of two or more kinds thereof.

In the case where the lubricating oil composition according to one embodiment of the present invention contains the anti-foaming agent as the additional component, the content of the anti-foaming agent is preferably 0.001 to 0.5% by mass based on the total amount (100% by mass) of the lubricating oil composition.

<Surfactant or Demulsifier>

Examples of the surfactant or demulsifier include a polyalkylene glycol-based nonionic surfactant, such as a polyoxyethylene alkyl ether, a polyoxyethylene alkyl phenyl ether, and a polyoxyethylene alkyl naphtyl ether. The surfactant or demulsifier may be used alone or as a combination of two or more kinds thereof.

In the case where the lubricating oil composition according to one embodiment of the present invention contains the surfactant or demulsifier as the additional component, the content of the surfactant or demulsifier is preferably 0.01 to 3% by mass based on the total amount (100% by mass) of the lubricating oil composition.

<Friction Modifier>

Examples of the friction modifier include a molybdenum-based friction modifier, such as molybdenum dithiocarbamate (MoDTC), molybdenum dithiophosphate (MoDTP), and an amine salt of molybdic acid; an ash-free friction modifier, such as an aliphatic amine, a fatty acid ester, a fatty acid amide, a fatty acid, an aliphatic alcohol, and an aliphatic ether each having at least one alkyl group or alkenyl group having 6 to 30 carbon atoms in the molecule; fat and oil, an amine, an amide, a sulfurized ester, a phosphate ester, a phosphite ester, and a phosphate ester amine salt.

In the case where the lubricating oil composition according to one embodiment of the present invention contains the friction modifier as the additional component, the content of the friction modifier is preferably 0.05 to 4% by mass based on the total amount (100% by mass) of the lubricating oil composition.

<Oiliness Improver>

Examples of the oiliness improver include an aliphatic saturated or unsaturated monocarboxylic acid, such as stearic acid and oleic acid; a polymerized fatty acid, such as dimer acid and hydrogenated dimer acid; a hydroxy fatty acid, such as ricinoleic acid and 12-hydroxystearic acid; an aliphatic saturated or unsaturated monoalcohol, such as lauryl alcohol and oleyl alcohol; an aliphatic saturated or unsaturated monoamine, such as stearyl amine and oleyl amine; an aliphatic saturated or unsaturated monocarboxylic acid amide, such as lauric amide and oleic amide; and a partial ester of a polyhydric alcohol, such as glycerin and sorbitol, and an aliphatic saturated or unsaturated monocarboxylic acid.

In the case where the lubricating oil composition according to one embodiment of the present invention contains the oiliness improver as the additional component, the content of the oiliness improver is preferably 0.01 to 5% by mass based on the total amount (100% by mass) of the lubricating oil composition.

<Rust Inhibitor>

Examples of the rust inhibitor include a fatty acid, an alkenylsuccinic acid half ester, a fatty acid soap, an alkylsulfonate salt, a polyhydric alcohol fatty acid ester, a fatty acid amine, an oxidized paraffin, and an alkyl polyoxyethylene ether.

In the case where the lubricating oil composition according to one embodiment of the present invention contains the rust inhibitor as the additional component, the content of the rust inhibitor is preferably 0.01 to 3% by mass based on the total amount (100% by mass) of the lubricating oil composition.

<Metal Deactivator>

Examples of the metal deactivator include a benzotriazole-based compound, a tolyltriazole-based compound, a thiadiazole-based compound, an imidazole-based compound, and a pyrimidine-based compound.

In the case where the lubricating oil composition according to one embodiment of the present invention contains the metal deactivator as the additional component, the content of the metal deactivator is preferably 0.01 to 5% by mass based on the total amount (100% by mass) of the lubricating oil composition.

[Properties of Lubricating Oil Composition]

<100° C. Kinematic Viscosity>

The lubricating oil composition of the present invention has a 100° C. kinematic viscosity of 9.3 $mm^2/s$ or less.

In the case where the 100° C. kinematic viscosity exceeds 9.3 $mm^2/s$, the lubricating oil composition cannot have a lowered viscosity to deteriorate the fuel saving capability.

The 100° C. kinematic viscosity of the lubricating oil composition according to one embodiment of the present invention is preferably 6.1 $mm^2/s$ to 9.3 $mm^2/s$, more preferably 6.1 $mm^2/s$ to 9.0 $mm^2/s$, and further preferably 6.1 $mm^2/s$ to 8.8 $mm^2/s$, from the aforementioned standpoint, and the standpoint of the oil film retention capability and the suppression of the Noack evaporation loss.

<40° C. Kinematic Viscosity>

The 40° C. kinematic viscosity of the lubricating oil composition according to one embodiment of the present invention is preferably 15.0 $mm^2/s$ to 35.0 $mm^2/s$, more preferably 17.0 $mm^2/s$ to 30.0 $mm^2/s$, further preferably 18.0 $mm^2/s$ to 30.0 $mm^2/s$, and still further preferably 19.0 $mm^2/s$ to 29.0 $mm^2/s$, from the standpoint of enhancing the fuel saving capability by reducing the viscosity of the lubricating oil composition, and the standpoint of the oil film retention capability and the suppression of the Noack evaporation loss.

<Viscosity Index>

The lubricating oil composition of the present invention necessarily has a viscosity index of 280 or more. In the case where the viscosity index is less than 280, the change in viscosity on the temperature cannot be sufficiently suppressed to fail to secure a sufficient fuel saving capability in some cases. The viscosity index is preferably 290 or more, more preferably 295 or more, and further preferably 300 or more.

<HTHS (High Temperature High Shear) Viscosity at 150° C.>

The lubricating oil composition according to one embodiment of the present invention preferably has an HTHS viscosity at 150° C. of 2.0 mPa·s to 2.8 mPa·s.

The HTHS viscosity at 150° C. that is 2.0 mPa·s or more facilitates the retention of the oil film. The HTHS viscosity at 150° C. that is 2.8 mPa·s or less facilitates the improvement of the fuel saving capability.

From this standpoint, the HTHS viscosity at 150° C. of the lubricating oil composition according to one embodiment of the present invention is more preferably 2.2 mPa·s or more, and further preferably 2.3 mPa·s or more. The HTHS viscosity at 150° C. thereof is more preferably 2.7 mPa·s or less, and further preferably 2.6 mPa·s or less.

The upper limit values and the lower limit values of these numerical ranges may be optionally combined. Specifically, the HTHS viscosity at 150° C. thereof is more preferably 2.2 mPa·s to 2.7 mPa·s, and further preferably 2.3 mPa·s to 2.6 mPa·s.

In the description herein, the HTHS viscosity at 150° C. is a value that is measured according to ASTM D4683 with a TBS high temperature viscometer (tapered bearing simulator viscometer) under a temperature condition of 150° C. at a shear velocity of $10^6$/s.

<Noack Evaporation Loss>

The lubricating oil composition according to one embodiment of the present invention preferably has a Noack evaporation loss (250° C., 1 hour) of 25% by mass or less, more preferably 24% by mass or less, and further preferably 23% by mass or less, from the standpoint of facilitating the suppression of the increase in viscosity of the lubricating oil composition, thereby further facilitating the exertion of the effects of the present invention. The Noack evaporation loss thereof is generally 0.1% by mass or more.

In the description herein, the Noack evaporation loss is a value that is measured according to JPI-5S-41-2004 under conditions of 250° C. and 1 hour.

[Method for Producing Lubricating Oil Composition]

The method for producing the lubricating oil composition of the present invention is not particularly limited.

For example, the method for producing the lubricating oil composition according to one embodiment of the present invention may be a method for producing a lubricating oil composition containing a base oil (A) and a viscosity index improver (B), the method including mixing the base oil (A) and the viscosity index improver (B), the base oil (A) containing a mineral oil (A1) and an oxygen-containing synthetic oil (A2), the viscosity index improver (B) containing a comb-shaped polymer (B1), the lubricating oil composition having a kinematic viscosity at 100° C. regulated to 9.3 $mm^2$/s or less, a viscosity index regulated to 280 or more, and a content Y (unit: % by mass) of the oxygen-containing synthetic oil (A2) based on the total amount of the lubricating oil composition being regulated to satisfy the following expression (1):

$$\alpha \leq Y < -3.7\ln(X) + \beta \quad (1)$$

wherein in the expression (1), α=0.5, β=19, and X represents a ratio (C/O) of the number of carbon atoms and the number of oxygen atoms per one molecule of the oxygen-containing synthetic oil (A2).

The method of mixing the components is not particularly limited, and examples thereof include a method including blending the viscosity index improver (B) in the base oil (A). The additives for a lubricating oil may be blended therein simultaneously with the viscosity index improver (B) or at a different time from the viscosity index improver (B).

The components each may be blended in the form of a solution (dispersion) having a diluent oil or the like added thereto. After blending the components, it is preferred that the mixture is uniformly dispersed through agitation by a known method.

[Applications of Lubricating Oil Composition]

The lubricating oil composition of the present invention is hard to increase in viscosity in the low temperature range, resulting in an excellent fuel saving capability, and is easy to increase in viscosity in the high temperature range, resulting in excellent wear resistance and excellent hydraulic characteristics and securing an oil film.

Therefore, the lubricating oil composition of the present invention is preferred as a lubricating oil composition used in an internal combustion engine used in vehicles, such as an automobile, and is more preferred as a lubricating oil composition used in an internal combustion engine of a hybrid automobile. The lubricating oil composition of the present invention is also preferred as a lubricating oil composition used in an internal combustion engine used in an automobile equipped with an idle-stop system.

Accordingly, the present invention also provides the following methods.

(1) A use method including using the lubricating oil composition of the present invention in an internal combustion engine of an automobile (2) A use method including using the lubricating oil composition of the present invention in an internal combustion engine of a hybrid automobile (3) A use method including using the lubricating oil composition of the present invention in an internal combustion engine of an automobile equipped with an idle-stop system

One Embodiment of Present Invention Provided

In one embodiment of the present invention, the following items [1] to [14] are provided.

[1] A lubricating oil composition containing a base oil (A) and a viscosity index improver (B), the base oil (A) containing a mineral oil (A1) and an oxygen-containing synthetic oil (A2), the viscosity index improver (B) containing a comb-shaped polymer (B1), the lubricating oil composition having a kinematic viscosity at 100° C. of 9.3 $mm^2$/s or less, a viscosity index of 280 or more, and a content Y (unit: % by mass) of the oxygen-containing synthetic oil (A2) based on the total amount of the lubricating oil composition satisfying the following expression (1):

$$\alpha \leq Y < -3.7\ln(X) + \beta \quad (1)$$

wherein in the expression (1), α=0.5, β=19, and X represents a ratio (C/O) of the number of carbon atoms and the number of oxygen atoms per one molecule of the oxygen-containing synthetic oil (A2).

[2] The lubricating oil composition according to the item [1], wherein the lubricating oil composition has a content ratio ((A2)/(B1)) in terms of mass ratio of the oxygen-containing synthetic oil (A2) and the comb-shaped polymer (B1) of 10.0 or less.

[3] The lubricating oil composition according to the item [1] or [2], wherein the oxygen-containing synthetic oil (A2)

is one or more kind selected from the group consisting of an ester oil, an ether oil, and an alcohol oil.

[4] The lubricating oil composition according to any one of the items [1] to [3], wherein the oxygen-containing synthetic oil (A2) has a number of oxygen atoms per one molecule of 1 to 10.

[5] The lubricating oil composition according to any one of the items [1] to [4], wherein the base oil (A) has a content ratio ((A1)/(A2)) in terms of mass ratio of the mineral oil (A1) and the oxygen-containing synthetic oil (A2) of 3.0 to 20.0.

[6] The lubricating oil composition according to any one of the items [1] to [5], wherein the oxygen-containing synthetic oil (A2) has a kinematic viscosity at 40° C. of 3.0 $mm^2/s$ to 20.0 $mm^2/s$.

[7] The lubricating oil composition according to any one of the items [1] to [6], wherein the base oil (A) has a kinematic viscosity at 40° C. of 3.0 $mm^2/s$ to 20.0 $mm^2/s$.

[8] The lubricating oil composition according to any one of the items [1] to [7], wherein the comb-shaped polymer (B1) contains a comb-shaped polymer (B1-1) having no polar group on a side chain.

[9] The lubricating oil composition according to any one of the items [1] to [8], wherein the lubricating oil composition has a kinematic viscosity at 100° C. of 6.1 $mm^2/s$ or more.

[10] The lubricating oil composition according to any one of the items [1] to [9], wherein the lubricating oil composition has a Noack evaporation loss of 25% by mass or less.

[11] The lubricating oil composition according to any one of the items [1] to [10], wherein the lubricating oil composition used in an internal combustion engine of an automobile.

[12] The lubricating oil composition according to any one of the items [1] to [10], wherein the lubricating oil composition used in an internal combustion engine of a hybrid automobile or a vehicle equipped with an idle-stop system.

[13] A use method including using the lubricating oil composition according to any one of the items [1] to [10] in an internal combustion engine of an automobile.

[14] A method for producing a lubricating oil composition, including mixing a base oil (A) and a viscosity index improver (B), the base oil (A) containing a mineral oil (A1) and an oxygen-containing synthetic oil (A2), the viscosity index improver (B) containing a comb-shaped polymer (B1), the lubricating oil composition having a kinematic viscosity at 100° C. regulated to 9.3 $mm^2/s$ or less, a viscosity index regulated to 280 or more, and a content Y (unit: % by mass) of the oxygen-containing synthetic oil (A2) based on the total amount of the lubricating oil composition being regulated to satisfy the following expression (1):

$$\alpha \leq Y < -3.7\ln(X) + \beta \quad (1)$$

wherein in the expression (1), $\alpha=0.5$, $\beta=19$, and X represents a ratio (C/O) of the number of carbon atoms and the number of oxygen atoms per one molecule of the oxygen-containing synthetic oil (A2).

EXAMPLES

The present invention will be described more specifically with reference to examples below, but the present invention is not limited to the examples.

[Measurement Methods of Property Values]

The properties of the raw materials used in Examples and Comparative Examples and the lubricating oil compositions of Examples and Comparative Examples were measured according to the following procedures.

(1) 40° C. Kinematic Viscosity, 100° C. Kinematic Viscosity, and Viscosity Index The 40° C. kinematic viscosity and the 100°c kinematic viscosity were measured according to JIS K2283:2000.

The viscosity index was calculated from the measured values of the 40° C. kinematic viscosity and the 100° C. kinematic viscosity according to JIS K2283:2000.

(2) HTHS Viscosity at 150° C.

The HTHS viscosity at 150° C. of the lubricating oil composition was measured according to ASTM D4683 with a TBS high temperature viscometer (tapered bearing simulator viscometer) under a temperature condition of 150° C. at a shear velocity of $10^6/s$.

(3) Noack Evaporation Loss

The Noack evaporation loss was measured according to JPI-5S-41-2004 under conditions of 250° C. and 1 hour.

(4) Mass Average Molecular Weight (Mw) and Number Average Molecular Weight (Mn)

The mass average molecular weight (Mw) was measured with a gel permeation chromatography equipment ("Type 1260 HPLC", produced by Agilent Technologies, Inc.) under the following condition, and a standard polystyrene conversion value was used.

(Measurement Condition)

Columns: two "Shodex LF404" connected in series

Column temperature: 35° C.

Developing solvent: chloroform

Flow rate: 0.3 mL/min (5) PSSI (Permanent Shear Stability Index)

The PSSI is a value that shows the viscosity reduction by shearing in terms of percentage derived from the polymer, and was calculated according to the following calculation expression defined in ASTM D6022-06 (2012).

$$PSSI = \frac{K_{V0} - K_{V1}}{K_{V0} - K_{Voil}} \times 100$$

In the calculation expression, $Kv_0$ represents the value of the kinematic viscosity at 100° C. of the mixture of the base oil and the polymer added thereto (before shearing). $Kv_1$ represents the value of the kinematic viscosity at 100° C. of the mixture of the base oil and the polymer added thereto (after shearing) measured according to ASTM D6278. $Kv_{oil}$ represents value of the kinematic viscosity at 100° C. of the base oil, and $Kv_0$ was regulated to 7.5 $mm^2/s$.

Examples, Comparative Examples, and Reference Examples

The raw materials shown below were sufficiently mixed at the blending ratios (% by mass) shown in Tables 2 to 6, so as to prepare lubricating oil compositions.

The details of the base oils and the additives used in Examples, Comparative Examples, and Reference Examples are as shown below.

<Mineral Oil (A1)>

(1) Mineral Oil 1

Mineral oil classified into Group III of API

40° C. Kinematic viscosity: 18.5 $mm^2/s$

100° C. Kinematic viscosity: 4.0 $mm^2/s$

Viscosity index: 128

Noack evaporation loss: 12% by mass (2) Mineral Oil 2

Mineral oil classified into Group II of API

40° C. Kinematic viscosity: 10.4 $mm^2/s$

100° C. Kinematic viscosity: 3.0 $mm^2/s$

Viscosity index: 115
Noack evaporation loss: 40% by mass

<Oxygen-Containing Synthetic Oil (A2)>

(1) Ester Oil 1

Trimethylolpropane trimethacrylate

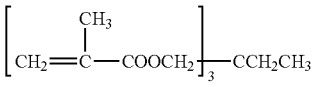

Number of carbon atoms (C): 18
Number of oxygen atoms (O): 6
C/O: 3
40° C. Kinematic viscosity: 19.8 $mm^2/s$
100° C. Kinematic viscosity: 4.3 $mm^2/s$
Viscosity index: 126
Noack evaporation loss: 3% by mass
Ester oil corresponding to polyol ester oil (2) Ester Oil 2

Diethyl sebacate (diethyl decanedioate)

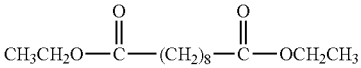

Number of carbon atoms (C): 14
Number of oxygen atoms (O): 4
C/O: 3.5
40° C. Kinematic viscosity: 11.5 $mm^2/s$
100° C. Kinematic viscosity: 3.2 $mm^2/s$
Viscosity index: 151
Noack evaporation loss: 15% by mass
Ester oil corresponding to diester oil (3) Ester Oil 3

Methyl oleate (methyl octadecenoate)

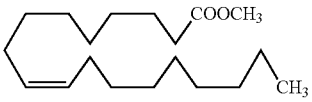

Number of carbon atoms (C): 19
Number of oxygen atoms (O): 2
C/O: 9.5
40° C. Kinematic viscosity: 5.78 $mm^2/s$
100° C. Kinematic viscosity: 2.1 $mm^2/s$
Viscosity index: 221
Noack evaporation loss: 32% by mass
Ester oil corresponding to monoester oil (4) Ester Oil 4

Isopropyl palmitate (isopropyl hexadecanoate)

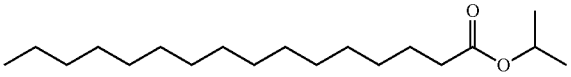

Number of carbon atoms (C): 19
Number of oxygen atoms (O): 2
C/O: 9.5
40° C. Kinematic viscosity: 5.03 $mm^2/s$
100° C. Kinematic viscosity: 1.9 $mm^2/s$
Viscosity index: 179
Ester oil corresponding to monoester oil (5) Ether Oil Polyoxyalkylene glycol methyl ether $$CH_3—(CH_2CH_2O)_n—OCH_3$$

Number of carbon atoms (C): 4
Number of oxygen atoms (O): 2
C/O: 2
40° C. Kinematic viscosity: 14.9 $mm^2/s$
100° C. Kinematic viscosity: 4.0 $mm^2/s$
Viscosity index: 193
Noack evaporation loss: 12% by mass Polyoxyalkylene glycol derivative represented by general formula (I), wherein $R^{a2}$ represents alkylene group having 2 carbon atoms, $R^{a1}$ and $R^{a3}$ represent methyl groups, and n is 20

<Non-Oxygen-Containing Synthetic Oil (A2')>

(1) PAO

Poly-α-olefin
40° C. Kinematic viscosity: 17.5 $mm^2/s$
100° C. Kinematic viscosity: 4.0 $mm^2/s$
Viscosity index: 125
Noack evaporation loss: 13% by mass <Viscosity Index Improver>

(1) Comb-Shaped Polymer 1

Comb-shaped PMA having no polar group
Mw: 310,000
Resin content: 23% by mass
PSSI: 1

(2) Comb-Shaped Polymer 2

Comb-shaped PMA having polar groups
Mw: 600,000
Resin content: 20% by mass
PSSI: 1

(3) PMA

Mw: 400,000
Resin content: 20% by mass

The details of the comb-shaped polymers 1 and 2 are shown in Table 1. The contents of the structural units are values that are obtained by analyzing through the $^{13}C$-NMR quantitative spectrum analysis. The macromonomer used was a one-end methacrylated hydrogenated polybutadiene having a structural unit derived from hydrogenated butadiene having one methacrylated end (Kraton Liquid (registered trade name) L-1253, produced by Kuraray Co., Ltd.). The mass average molecular weight was approximately 7,000, and the number average molecular weight was approximately 6,800. The butyl group-containing monomer used was n-butyl methacrylate. The butoxyethyl group-containing monomer used was butoxyethyl methacrylate. The long chain alkyl group-containing monomer used was a mixture of n-dodecyl methacrylate and n-tridecyl methacrylate.

TABLE 1

| | Mw × $10^4$ | Mw/Mn | Structural unit derived from butyl group-containing monomer | Structural unit derived from long chain alkyl group-containing monomer | Structural unit derived from butoxyethyl group-containing monomer | Structural unit derived from macromonomer |
|---|---|---|---|---|---|---|
| Comb-shaped polymer 1 | 31 | 2.0 | 79 | 7 | — | 14 |

TABLE 1-continued

| | Mw × $10^4$ | Mw/Mn | Structural unit derived from butyl group-containing monomer | Structural unit derived from long chain alkyl group-containing monomer | Structural unit derived from butoxyethyl group-containing monomer | Structural unit derived from macromonomer |
|---|---|---|---|---|---|---|
| Comb-shaped polymer 2 | 60 | 2.4 | 74 | 14 | 11 | 1 |

Unit: % by mol

<Additional Additives>

An additive package according to the API/ILSAC Standard and the SP/GF-6 Standard was used. The additive package contained the following additives:

a metal-based detergent, a dispersant, an anti-wear agent, an antioxidant, a friction modifier, and an anti-foaming agent.

[Evaluation]

The specific viscosity was calculated for estimation the effect of increasing the viscosity with the viscosity index improver. It can be understood that a larger specific viscosity means a larger temperature dependency of the viscosity of the lubricating oil, i.e., the viscosity is easy to increase. In contrast, it can be understood that a smaller specific viscosity means a smaller temperature dependency of the viscosity of the lubricating oil, i.e., the viscosity is hard to increase.

The specific viscosity at 40° C. was calculated according to the following expression (X1).

$$(\text{Specific viscosity at } 40^\circ \text{ C.}) = (40KV_b - 40KV_a)/(40KV_a) \quad \text{(X1)}$$

In the expression (X1), $40KV_b$ represents the 40° C. kinematic viscosity of the lubricating oil composition to be evaluated, and $40KV_a$ represents the 40° C. kinematic viscosity of the lubricating oil composition containing the base oil to be evaluated and the additional additives, having no viscosity index improver mixed therein. In other words, $40KV_a$ represents the 40° C. kinematic viscosity of the mixture of the base oil and the additional additives obtained by removing the viscosity index improver from the lubricating oil composition to be evaluated.

The specific viscosity at 100° C. was calculated according to the following expression (X2).

$$(\text{Specific viscosity at } 100^\circ \text{ C.}) = (100KV_b - 100KV_a)/(100KV_a) \quad \text{(X2)}$$

In the expression (X2), $100KV_b$ represents the 100° C. kinematic viscosity of the lubricating oil composition to be evaluated, and $100KV_a$ represents the 100° C. kinematic viscosity of the lubricating oil composition containing the base oil to be evaluated and the additional additives, having no viscosity index improver mixed therein. In other words, $100KV_a$ represents the 100° C. kinematic viscosity of the mixture of the base oil and the additional additives obtained by removing the viscosity index improver from the lubricating oil composition to be evaluated.

A specific viscosity at 40° C. of 0.40 or less was judged as acceptable. A smaller value thereof is understood that the viscosity is hard to increase in the low temperature range.

A ratio (specific viscosity at 100° C.)/(specific viscosity at 40° C.) of 2.6 or more was judged as acceptable. A larger value thereof is understood that the viscosity is hard to increase in the low temperature range, and a sufficient effect of increasing the viscosity is secured in the high temperature range.

The results are shown in Tables 2 to 6. In Tables 2 to 6, the contents of the comb-shaped polymer (B1) and the PMA each are the content in terms of resin content.

TABLE 2

| | | | | Unit | Reference Example 1 | Reference Example 2 | Reference Example 3 | Comparative Example 1 | Comparative Example 2 |
|---|---|---|---|---|---|---|---|---|---|
| Lubricating oil composition | Mineral oil (A1) | Mineral oil 1 | | % by mass | 76.7 | 76.6 | 55.2 | 71.6 | 66.6 |
| | | Mineral oil 2 | | % by mass | 10.5 | 10.5 | 31.9 | 10.5 | 10.5 |
| | Oxygen-containing synthetic oil (A2) | Ester oil 1 | Trimethylolpropane trimethacrylate | % by mass | | | | | |
| | | Ester oil 2 | Diethyl sebacate | % by mass | | | | | |
| | | Ester oil 3 | Methyl oleate | % by mass | | | | | |
| | | Ester oil 4 | Isopropyl palmitate | % by mass | | | | | |
| | | Ether oil | Polyoxyalkylene glycol methyl ether | % by mass | | | | | |
| | Non oxygen-containing synthetic oil (A2') | | PAO | % by mass | | | | 5.0 | 10.0 |
| | Viscosity index improver (B) | Comb-shaped polymer (B1) | Comb-shaped polymer 1 (Comb-shaped PMA having no polar group) | % by mass | | | 2.4 | | |

TABLE 2-continued

| | | | Unit | Reference Example 1 | Reference Example 2 | Reference Example 3 | Comparative Example 1 | Comparative Example 2 |
|---|---|---|---|---|---|---|---|---|
| | | Comb-shaped polymer 2 (Comb-shaped PMA having polar groups) | % by mass | | 2.4 | | 2.4 | 2.4 |
| | | PMA | % by mass | 2.3 | | | | |
| | Additional additive | | % by mass | 10.5 | 10.5 | 10.5 | 10.5 | 10.5 |
| | Total | | % by mass | 100.00 | 100.00 | 100.00 | 100.00 | 100.00 |
| | Content of mineral oil (A1) (based on total amount of lubricating oil composition) | | % by mass | 87.2 | 87.1 | 87.1 | 82.1 | 77.1 |
| | Content of oxygen containing synthetic oil (A2) (based on total amount of lubricating oil composition) | | % by mass | 0.0 | 0.0 | 0.0 | 0.0 | 0.0 |
| | ((A1)/(A2)) (mass ratio) | | — | — | — | — | — | — |
| | ((A2)/(B1)) (mass ratio) | | — | 0.0 | 0.0 | 0.0 | 0.0 | 0.0 |
| Properties of mixed base oil | 40° C. Kinematic viscosity | | $mm^2/s$ | 16.6 | 16.6 | 13.7 | 16.6 | 16.7 |
| | 100° C. Kinematic viscosity | | $mm^2/s$ | 3.8 | 3.8 | 3.4 | 3.8 | 3.8 |
| | Viscosity index | | — | 125 | 125 | 120 | 125 | 124 |
| Properties of mixed base oil + additional additive | 40° C. Kinematic viscosity (40 KVa) | | $mm^2/s$ | 21.6 | 21.6 | 18.7 | 21.6 | 21.7 |
| | 100° C. Kinematic viscosity (100 KVa) | | $mm^2/s$ | 4.7 | 4.7 | 4.2 | 4.6 | 4.6 |
| Properties of lubricating oil composition | 40° C. Kinematic viscosity (40 KVb) | | $mm^2/s$ | 31.8 | 26.5 | 20.9 | 26.5 | 26.6 |
| | 100° C. Kinematic viscosity (100 KVb) | | $mm^2/s$ | 8.2 | 7.5 | 5.9 | 7.5 | 7.5 |
| | Viscosity index | | — | 249 | 273 | 261 | 273 | 273 |
| | 150° C. HTHS viscosity | | mPa · s | 2.6 | 2.6 | 2.3 | 2.6 | 2.6 |
| | Noack evaporation loss | | % by mass | 14 | 14 | 21 | 13 | 13 |
| Evaluation results | Specific viscosity at 40° C. | | — | 0.47 | 0.23 | 0.12 | 0.23 | 0.23 |
| | Specific viscosity at 100° C. | | — | 0.75 | 0.60 | 0.40 | 0.61 | 0.61 |
| | Specific viscosity at 100° C./ specific viscosity at 40° C. | | — | 1.59 | 2.63 | 3.40 | 2.69 | 2.70 |

TABLE 3

| | | | | Unit | Example 1 | Example 2 | Comparative Example 3 |
|---|---|---|---|---|---|---|---|
| Lubricating oil composition | Mineral oil (A1) | Mineral oil 1 | | % by mass | 71.6 | 66.6 | 56.6 |
| | | Mineral oil 2 | | % by mass | 10.5 | 10.5 | 10.5 |
| | Oxygen-containing synthetic oil (A2) | Ester oil 1 | Trimethylolpropane trimethacrylate | % by mass | 5.0 | 10.0 | 20.0 |
| | | Ester oil 2 | Diethyl sebacate | % by mass | | | |
| | | Ester oil 3 | Methyl oleate | % by mass | | | |
| | | Ester oil 4 | Isopropyl palmitate | % by mass | | | |
| | | Ether oil | Polyoxyalkylene glycol methyl ether | % by mass | | | |
| | Non oxygen-containing synthetic oil (A2') | | PAO | % by mass | | | |
| | Viscosity index improver (B) | Comb-shaped polymer (B1) | Comb shaped polymer 1 (Comb-shaped PMA having no polar group) | % by mass | | | |
| | | | Comb-shaped polymer 2 (Comb-shaped PMA having polar groups) | % by mass | 2.4 | 2.4 | 2.4 |
| | | | PMA | % by mass | | | |
| | Additional additive | | | % by mass | 10.5 | 10.5 | 10.5 |
| | Total | | | % by mass | 100.00 | 100.00 | 100.00 |
| | Content of mineral oil (A1) (based on total amount of lubricating oil composition) | | | % by mass | 82.1 | 77.1 | 67.1 |
| | Content of oxygen containing synthetic oil (A2) (based on total amount of lubricating oil composition) | | | % by mass | 5.0 | 10.0 | 20.0 |
| | ((A1)/(A2)) (mass ratio) | | | — | 16.4 | 7.7 | 3.4 |
| | ((A2)/(B1)) (mass ratio) | | | — | 2.1 | 4.2 | 8.3 |
| Properties of mixed base oil | 40° C. Kinematic viscosity | | | $mm^2/s$ | 16.7 | 16.8 | 17.0 |
| | 100° C. Kinematic viscosity | | | $mm^2/s$ | 3.9 | 4.0 | 4.2 |
| | Viscosity index | | | — | 125 | 140 | 160 |

TABLE 3-continued

| | | Unit | Example 1 | Example 2 | Comparative Example 3 |
|---|---|---|---|---|---|
| Properties of mixed base oil + additional additive | 40° C. Kinematic viscosity (40 KVa) | $mm^2/s$ | 21.7 | 21.8 | 22.0 |
| | 100° C. Kinematic viscosity (100 KVa) | $mm^2/s$ | 4.7 | 4.8 | 5.0 |
| Properties of lubricating oil composition | 40° C. Kinematic viscosity (40 KVb) | $mm^2/s$ | 27.2 | 29.2 | 35.9 |
| | 100° C. Kinematic viscosity (100 KVb) | $mm^2/s$ | 8.1 | 9.1 | 10.6 |
| | Viscosity index | — | 300 | 320 | 302 |
| | 150° C. HTHS viscosity | mPa · s | 2.6 | 2.7 | 2.9 |
| | Noack evaporation loss | % by mass | 13 | 13 | 12 |
| Evaluation results | Specific viscosity at 40° C. | — | 0.26 | 0.34 | 0.63 |
| | Specific viscosity at 100° C. | — | 0.73 | 0.88 | 1.10 |
| | Specific viscosity at 100° C./ specific viscosity at 40° C. | — | 2.85 | 2.61 | 1.73 |

TABLE 4

| | | | | Unit | Example 3 | Example 4 | Comparative Example 4 | Comparative Example 5 | Example 5 | Example 6 | Comparative Example 6 |
|---|---|---|---|---|---|---|---|---|---|---|---|
| Lubricating oil composition | Mineral oil (A1) | Mineral oil 1 | | % by mass | 71.6 | 66.6 | 61.6 | 56.6 | 49.8 | 44.8 | 34.8 |
| | | Mineral oil 2 | | % by mass | 10.5 | 10.5 | 10.5 | 10.5 | 31.9 | 31.9 | 31.9 |
| | Oxygen containing synthetic oil (A2) | Ester oil 1 | Trimethylolpropane trimethacrylate | % by mass | | | | | | | |
| | | Ester oil 2 | Diethyl sebacate | % by mass | 5.0 | 10.0 | 15.0 | 20.0 | 5.0 | 10.0 | 20.0 |
| | | Ester oil 3 | Methyl oleate | % by mass | | | | | | | |
| | | Ester oil 4 | Isopropyl palmitate | % by mass | | | | | | | |
| | | Ether oil | Polyoxyalkylene glycol methyl ether | % by mass | | | | | | | |
| | Non oxygen containing synthetic oil (A2') | | PAO | % by mass | | | | | | | |
| | Viscosity index improver (B) | Comb-shaped polymer (B1) | Comb-shaped polymer 1 (Comb-shaped PMA having no polar group) | % by mass | | | | | | | |
| | | | Comb-shaped polymer 2 (Comb-shaped PMA having polar groups) | % by mass | 2.4 | 2.4 | 2.4 | 2.4 | 2.8 | 2.8 | 2.8 |
| | | | PMA | % by mass | | | | | | | |
| | Additional additive | | | % by mass | 10.5 | 10.5 | 10.5 | 10.5 | 10.5 | 10.5 | 10.5 |
| | Total | | | % by mass | 100.00 | 100.00 | 100.00 | 100.00 | 100.00 | 100.00 | 100.00 |
| | Content of mineral oil (A1) (based on total amount of lubricating oil composition) | | | % by mass | 82.1 | 77.1 | 72.1 | 67.1 | 81.7 | 76.7 | 66.7 |
| | Content of oxygen containing synthetic oil (A2) (based on total amount of lubricating oil composition) | | | % by mass | 5.0 | 10.0 | 15.0 | 20.0 | 5.0 | 10.0 | 20.0 |
| | ((A1)/(A2)) (mass ratio) | | | — | 16.4 | 7.7 | 4.8 | 3.4 | 16.3 | 7.7 | 3.3 |
| | ((A2)/(B1)) (mass ratio) | | | — | 2.1 | 4.2 | 6.3 | 8.3 | 1.8 | 3.6 | 7.1 |
| Properties of mixed base oil | 40° C. Kinematic viscosity | | | $mm^2/s$ | 16.1 | 15.6 | 15.4 | 15.2 | 13.3 | 13.0 | 12.2 |
| | 100° C. Kinematic viscosity | | | $mm^2/s$ | 3.8 | 3.7 | 3.7 | 3.7 | 3.3 | 3.3 | 3.2 |
| | Viscosity index | | | — | 126 | 128 | 129 | 130 | 121 | 123 | 126 |
| Properties of mixed base oil + additional additive | 40° C. Kinematic viscosity (40 KVa) | | | $mm^2/s$ | 21.1 | 20.6 | 20.4 | 20.2 | 18.3 | 17.9 | 17.2 |
| | 100° C. Kinematic viscosity (100 KVa) | | | $mm^2/s$ | 4.6 | 4.5 | 4.5 | 4.5 | 4.2 | 4.1 | 4.0 |
| Properties of lubricating oil composition | 40° C. Kinematic viscosity (40 KVb) | | | $mm^2/s$ | 26.4 | 26.4 | 28.3 | 30.1 | 24.1 | 24.6 | 25.8 |
| | 100° C. Kinematic viscosity (100 KVb) | | | $mm^2/s$ | 7.9 | 8.3 | 8.9 | 9.5 | 8.2 | 8.6 | 9.9 |
| | Viscosity index | | | — | 301 | 320 | 324 | 327 | 355 | 365 | 413 |
| | 150° C. HTHS viscosity | | | mPa · s | 2.6 | 2.6 | 2.7 | 2.7 | 2.6 | 2.6 | 2.7 |
| | Noack evaporation loss | | | % by mass | 14 | 15 | 15 | 15 | 21 | 21 | 22 |
| Evaluation | Specific viscosity at 40° C. | | | — | 0.25 | 0.28 | 0.39 | 0.49 | 0.31 | 0.37 | 0.50 |

TABLE 4-continued

| | | Unit | Example 3 | Example 4 | Comparative Example 4 | Comparative Example 5 | Example 5 | Example 6 | Comparative Example 6 |
|---|---|---|---|---|---|---|---|---|---|
| results | Specific viscosity at 100° C. | — | 0.72 | 0.82 | 0.97 | 1.12 | 0.99 | 1.09 | 1.47 |
| | Specific viscosity at 100° C./ specific viscosity at 40° C. | — | 2.89 | 2.92 | 2.52 | 2.27 | 3.15 | 2.95 | 2.93 |

TABLE 5

| | | | | Unit | Example 7 | Comparative Example 7 | Comparative Example 8 | Example 8 | Example 9 | Example 10 | Example 11 |
|---|---|---|---|---|---|---|---|---|---|---|---|
| Lubricating oil composition | Mineral oil (A1) | Mineral oil 1 | | % by mass | 51.7 | 48.7 | 46.7 | 51.4 | 52.1 | 71.6 | 66.6 |
| | | Mineral oil 2 | | % by mass | 27.0 | 23.0 | 18.0 | 27.0 | 27.0 | 10.5 | 10.5 |
| | Oxygen-containing synthetic oil (A2) | Ester oil 1 | Trimethylolpropane trimethacrylate | % by mass | | | | | | | |
| | | Ester oil 2 | Diethyl sebacate | % by mass | | | | | | | |
| | | Ester oil 3 | Methyl oleate | % by mass | 8.0 | 15.0 | 22.0 | 8.0 | 8.0 | | |
| | | Ester oil 4 | Isopropyl palmitate | % by mass | | | | | | 5.0 | 10.0 |
| | | Ether oil | Polyoxyalkylene glycol methyl ether | % by mass | | | | | | | |
| | Non oxygen containing synthetic oil (A2') | | PAO | % by mass | | | | | | | |
| | Viscosity index improver (B) | Comb-shaped polymer (B1) | Comb-shaped polymer 1 (Comb-shaped PMA having no polar group) | % by mass | | | | 3.1 | 2.4 | | |
| | | | Comb-shaped polymer 2 (Comb-shaped PMA having polar groups) | % by mass | 2.8 | 2.8 | 2.8 | | | 2.4 | 2.4 |
| | | | PMA | % by mass | | | | | | | |
| | Additional additive | | | % by mass | 10.5 | 10.5 | 10.5 | 10.5 | 10.5 | 10.5 | 10.5 |
| | Total | | | % by mass | 100.00 | 100.00 | 100.00 | 100.00 | 100.00 | 100.00 | 100.00 |
| | Content of mineral oil (A1) (based on total amount of lubricating oil composition) | | | % by mass | 78.7 | 71.7 | 64.7 | 78.4 | 79.1 | 82.1 | 77.1 |
| | Content of oxygen containing synthetic oil (A2) (based on total amount of lubricating oil composition) | | | % by mass | 8.0 | 15.0 | 22.0 | 8.0 | 8.0 | 5.0 | 10.0 |
| | ((A1)/(A2)) (mass ratio) | | | — | 9.8 | 4.8 | 2.9 | 9.8 | 9.9 | 16.4 | 7.7 |
| | ((A2)/(B1)) (mass ratio) | | | — | 2.9 | 5.4 | 7.9 | 2.6 | 3.3 | 2.1 | 4.2 |
| Properties of mixed base oil | 40° C. Kinematic viscosity | | | $mm^2/s$ | 12.5 | 11.6 | 10.6 | 12.5 | 12.5 | 15.1 | 13.7 |
| | 100° C. Kinematic viscosity | | | $mm^2/s$ | 3.2 | 3.1 | 3.0 | 3.2 | 3.2 | 3.6 | 3.4 |
| | Viscosity index | | | — | 127 | 133 | 146 | 127 | 127 | 127 | 129 |
| Properties of mixed base oil + additional additive | 40° C. Kinematic viscosity (40 KVa) | | | $mm^2/s$ | 17.5 | 16.6 | 15.6 | 17.5 | 17.5 | 20.0 | 18.7 |
| | 100° C. Kinematic viscosity (100 KVa) | | | $mm^2/s$ | 4.1 | 3.9 | 3.8 | 4.1 | 4.1 | 4.5 | 4.3 |
| Properties of lubricating oil composition | 40° C. Kinematic viscosity (40 KVb) | | | $mm^2/s$ | 23.7 | 23.6 | 25.4 | 21.9 | 20.6 | 25.0 | 23.8 |
| | 100° C. Kinematic viscosity (100 KVb) | | | $mm^2/s$ | 8.2 | 8.7 | 9.2 | 7.2 | 6.2 | 7.7 | 7.9 |
| | Viscosity index | | | — | 358 | 391 | 380 | 329 | 287 | 309 | 343 |
| | 150° C. HTHS viscosity | | | mPa · s | 2.6 | 2.6 | 2.6 | 2.6 | 2.3 | 2.5 | 2.5 |
| | Noack evaporation loss | | | % by mass | 21 | 22 | 22 | 22 | 22 | 17 | 21 |
| Evaluation results | Specific viscosity at 40° C. | | | — | 0.35 | 0.43 | 0.63 | 0.25 | 0.17 | 0.25 | 0.28 |
| | Specific viscosity at 100° C. | | | — | 1.02 | 1.22 | 1.40 | 0.76 | 0.53 | 0.73 | 0.87 |
| | Specific viscosity at 100° C./ specific viscosity at 40° C. | | | — | 2.89 | 2.88 | 2.22 | 3.07 | 3.05 | 2.95 | 3.13 |

TABLE 6

| | | | | Unit | Example 12 | Example 13 |
|---|---|---|---|---|---|---|
| Lubricating oil composition | Mineral oil (A1) | Mineral oil 1 | | % by mass | 71.6 | 66.6 |
| | | Mineral oil 2 | | % by mass | 10.5 | 10.5 |
| | Oxygen containing | Ester oil 1 | Trimethylolpropane trimethacrylate | % by mass | | |

TABLE 6-continued

| | | | | Unit | Example 12 | Example 13 |
|---|---|---|---|---|---|---|
| | synthetic oil (A2) | Ester oil 2 | Diethyl sebacate | % by mass | | |
| | | Ester oil 3 | Methyl oleate | % by mass | | |
| | | Ester oil 4 | Isopropyl palmitate | % by mass | | |
| | | Ether oil | Polyoxyalkylene glycol methyl ether | % by mass | 5.0 | 10.0 |
| | Non oxygen containing synthetic oil (A2') | | PAO | % by mass | | |
| | Viscosity index improver (B) | Comb-shaped polymer (B1) | Comb-shaped polymer 1 (Comb-shaped PMA having no polar group) | % by mass | | |
| | | | Comb shaped polymer 2 (Comb shaped PMA having polar groups) | % by mass | 2.4 | 2.4 |
| | | | PMA | % by mass | | |
| | Additional additive | | | % by mass | 10.5 | 10.5 |
| | Total | | | % by mass | 100.00 | 100.00 |
| | Content of mineral oil (A1) (based on total amount of lubricating oil composition) | | | % by mass | 82.1 | 77.1 |
| | Content of oxygen containing synthetic oil (A2) (based on total amount of lubricating oil composition) | | | % by mass | 5.0 | 10.0 |
| | ((A1)/(A2)) (mass ratio) | | | — | 16.4 | 7.7 |
| | ((A2)/(B1)) (mass ratio) | | | — | 2.1 | 4.2 |
| Properties of mixed base oil | 40° C. Kinematic viscosity | | | $mm^2/s$ | 16.5 | 16.4 |
| | 100° C. Kinematic viscosity | | | $mm^2/s$ | 3.8 | 3.8 |
| | Viscosity index | | | — | 122 | 124 |
| Properties of mixed base oil + additional additive | 40° C. Kinematic viscosity (40 KVa) | | | $mm^2/s$ | 21.5 | 21.4 |
| | 100° C. Kinematic viscosity (100 KVa) | | | $mm^2/s$ | 4.6 | 4.6 |
| Properties of lubricating oil composition | 40° C. Kinematic viscosity (40 KVb) | | | $mm^2/s$ | 26.7 | 27.4 |
| | 100° C. Kinematic viscosity (100 KVb) | | | $mm^2/s$ | 8.0 | 8.6 |
| | Viscosity index | | | — | 300 | 322 |
| | 150° C. HTHS viscosity | | | mPa · s | 2.6 | 2.6 |
| | Noack evaporation loss | | | % by mass | 14 | 15 |
| Evaluation results | Specific viscosity at 40° C. | | | — | 0.24 | 0.28 |
| | Specific viscosity at 100° C. | | | — | 0.73 | 0.86 |
| | Specific viscosity at 100° C./ specific viscosity at 40° C. | | | — | 3.00 | 3.05 |

The following matters are understood from the results shown in Table 2.

As shown in Reference Example 1, it is understood that in the case where PMA is used as the viscosity index improver, the specific viscosity at 40° C. is larger to fail to reduce the viscosity of the lubricating oil composition in the low temperature range (40° C.).

On the other hand, as shown in Reference Examples 2 and 3, it is understood that in the case where the comb-shaped polymer is used as the viscosity index improver, the specific viscosity at 40° C. is small to reduce the viscosity of the lubricating oil composition in the low temperature range (40° C.). Furthermore, the ratio (specific viscosity at 100° C.)/(specific viscosity at 40° C.) is large, and it can be said that the viscosity is hard to increase in the low temperature range, and the sufficient effect of increasing the viscosity can be secured in the high temperature range. However, it is understood that in Reference Examples 2 and 3, the viscosity index of the lubricating oil composition cannot be sufficiently enhanced.

It is understood that in Comparative Examples 1 and 2 where a part of the mineral oil 1 is replaced by PAO, the viscosity index of the lubricating oil composition cannot be sufficiently enhanced.

The following matters are understood from the results shown in Table 3.

In Table 3, the polyol ester having C/O of 3 is used as the oxygen-containing synthetic oil (A2).

Therefore, the content Y (unit: % by mass) of the oxygen-containing synthetic oil (A2) defined by the expression (1) is $0.5 \leq Y < 14.94$.

As shown in Examples 1 and 2, in the case where the content of the oxygen-containing synthetic oil (A2) is less than 14.94% by mass, it is understood that the specific viscosity at 40° C. is small to reduce the viscosity of the lubricating oil composition in the low temperature range (40° C.). Furthermore, the ratio (specific viscosity at 100° C.)/(specific viscosity at 40° C.) is large, and it can be said that the viscosity is hard to increase in the low temperature range, and the sufficient effect of increasing the viscosity can be secured in the high temperature range.

On the other hand, as shown in Comparative Example 3, it is understood that in the case where the content of the oxygen-containing synthetic oil (A2) is 20% by mass, the specific viscosity at 40° C. is large, and the viscosity is easy to increase in the low temperature range.

The following matters are understood from the results shown in Table 4.

In Table 4, the diester having C/O of 3.5 is used as the oxygen-containing synthetic oil (A2).

Therefore, the content Y (unit: % by mass) of the oxygen-containing synthetic oil (A2) defined by the expression (1) is $0.5 \leq Y < 14.36$.

As shown in Examples 3 to 6, in the case where the content of the oxygen-containing synthetic oil (A2) is less than 14.36% by mass, it is understood that the specific viscosity at 40° C. is small to reduce the viscosity of the lubricating oil composition in the low temperature range (40° C.). Furthermore, the ratio of the specific viscosity (specific viscosity at 100° C.)/(kinematic viscosity at 40° C.) is large, and it can be said that the viscosity is hard to increase in the low temperature range, and the sufficient effect of increasing the viscosity can be secured in the high temperature range.

On the other hand, as shown in Comparative Examples 4 to 6, it is understood that in the case where the content of the oxygen-containing synthetic oil (A2) is 15% by mass or more, the specific viscosity at 40° C. is large, and the viscosity is easy to increase in the low temperature range.

The following matters are understood from the results shown in Table 5.

In Table 5, the monoester having C/O of 9.5 is used as the oxygen-containing synthetic oil (A2).

Therefore, the content Y (unit: % by mass) of the oxygen-containing synthetic oil (A2) defined by the expression (1) is $0.5 \leq Y < 10.67$.

As shown in Examples 7 to 11, in the case where the content of the oxygen-containing synthetic oil (A2) is less than 10.67% by mass, it can be said that the specific viscosity at 40° C. is small to reduce the viscosity in the low temperature range. Furthermore, the ratio (specific viscosity at 100° C.)/(specific viscosity at 40° C.) is large, and it can be said that the viscosity is hard to increase in the low temperature range, and the sufficient effect of increasing the viscosity can be secured in the high temperature range.

On the other hand, as shown in Comparative Examples 7 and 8, it is understood that in the case where the content of the oxygen-containing synthetic oil (A2) is 15% by mass or more, the specific viscosity at 40° C. is large, and the viscosity is easy to increase in the low temperature range.

The following matters are understood from the results shown in Table 6.

In Table 6, the ether having C/O of 2 is used as the oxygen-containing synthetic oil (A2).

Therefore, the content Y (unit: % by mass) of the oxygen-containing synthetic oil (A2) defined by the expression (1) is $0.5 \leq Y < 16.44$.

As shown in Examples 12 and 13, in the case where the content of the oxygen-containing synthetic oil (A2) is less than 16.44% by mass, it can be said that the specific viscosity at 40° C. is small to reduce the viscosity in the low temperature range. Furthermore, the ratio (specific viscosity at 100° C.)/(specific viscosity at 40° C.) is large, and it can be said that the viscosity is hard to increase in the low temperature range, and the sufficient effect of increasing the viscosity can be secured in the high temperature range.

The invention claimed is:

1. A lubricating oil composition, comprising:

a base oil comprising a mineral oil and an oxygen-containing synthetic oil; and a viscosity index improver comprising a comb-shaped polymer, wherein the lubricating oil composition has a kinematic viscosity at 100° C. of 9.3 $mm^2/s$ or less, a viscosity index of 280 or more, and a content Y (% by mass) of the oxygen-containing synthetic oil based on a total amount of the lubricating oil composition satisfying $\alpha \leq Y < -3.7 \ln(X) + \beta$ where $\alpha = 1.0$, $\beta = 19$, and X is a ratio of a number of carbon atoms and a number of oxygen atoms per one molecule of the oxygen-containing synthetic oil, the base oil has a content ratio in terms of a mass ratio of the mineral oil and the oxygen-containing synthetic oil in a range of 3.0 to 20.0, and the resin content of the comb-shaped polymer is in a range of 0.5% by mass to 5.0% by mass based on the total amount of the lubricating oil composition the lubricating oil composition has a high temperature high shear viscosity at 150° C. of 2.70 mPa·s or less, and if the comb-shaped polymer comprises a comb-shaped polymer having a polar group on a side chain, the mass ratio of the mineral oil and the oxygen-containing synthetic oil is in a range of 3.0 to 18.0.

2. The lubricating oil composition according to claim 1, wherein the lubricating oil composition has a content ratio in terms of a mass ratio of the oxygen-containing synthetic oil and the comb-shaped polymer of 10.0 or less.

3. The lubricating oil composition according to claim 1, wherein the oxygen-containing synthetic oil is at least one selected from the group consisting of an ester oil, an ether oil, and an alcohol oil.

4. The lubricating oil composition according to claim 1, wherein the oxygen-containing synthetic oil has a number of oxygen atoms per one molecule of 1 to 10.

5. The lubricating oil composition according to claim 1, wherein the oxygen-containing synthetic oil has a kinematic viscosity at 40° C. in a range of 3.0 $mm^2/s$ to 20.0 $mm^2/s$.

6. The lubricating oil composition according to claim 1, wherein the base oil has a kinematic viscosity at 40° C. in a range of 3.0 $mm^2/s$ to 20.0 $mm^2/s$.

7. The lubricating oil composition according to claim 1, wherein the comb-shaped polymer comprises a comb-shaped polymer having no polar group on a side chain.

8. The lubricating oil composition according to claim 1, wherein the lubricating oil composition has a kinematic viscosity at 100° C. of 6.1 $mm^2/s$ or more.

9. The lubricating oil composition according to claim 1, wherein the lubricating oil composition has a Noack evaporation loss of 25% by mass or less.

10. The lubricating oil composition according to claim 1, wherein the lubricating oil composition has a kinematic viscosity at 100° C. of 8.8 $mm^2/s$ or less.

11. The lubricating oil composition according to claim 1, wherein the lubricating oil composition has a viscosity index of 290 or more.

12. A method comprising lubricating an internal combustion engine of an automobile with the lubricating oil composition according to claim 1.

13. A method for producing a lubricating oil composition, comprising:

mixing a base oil comprising a mineral oil and an oxygen-containing synthetic oil, and a viscosity index improver comprising a comb-shaped polymer, wherein the lubricating oil composition has a kinematic viscosity at 100° C. regulated to 9.3 $mm^2/s$ or less, a viscosity index regulated to 280 or more, and a content Y (% by mass) of the oxygen-containing synthetic oil based on a total amount of the lubricating oil composition being regulated to satisfy $\alpha \leq Y < -3.7 \ln(X) + \beta$ (1) where $\alpha = 1.0$, $\beta = 19$, and X is a ratio of a number of carbon atoms and a number of oxygen atoms per one molecule of the oxygen-containing synthetic oil, the base oil has a content ratio in terms of a mass ratio of the mineral oil and the oxygen-containing synthetic oil in a range of 3.0 to 20.0, and the resin content of the comb-shaped polymer (B1) is in a range of 0.5% by mass to 5.0% by mass based on the total amount of the lubricating oil composition the lubricating oil composition has a high temperature high shear viscosity at 150° C. of 2.70 mPa·s or less, and if the comb-shaped polymer comprises a comb-shaped polymer having a polar group on a side chain, the mass ratio of the mineral oil and the oxygen-containing synthetic oil is in a range of 3.0 to 18.0.

* * * * *